US012601343B2

(12) United States Patent
Hunter et al.

(10) Patent No.: US 12,601,343 B2
(45) Date of Patent: Apr. 14, 2026

(54) COOLING FOR BELLOWS PUMP

(71) Applicant: Halliburton Energy Services, Inc., Houston, TX (US)

(72) Inventors: Timothy Holiman Hunter, Duncan, OK (US); Justin Lee Hurst, Duncan, OK (US); Andrew Silas Clyburn, Duncan, OK (US); Kurt R. Harpold, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 13 days.

(21) Appl. No.: 18/398,885

(22) Filed: Dec. 28, 2023

(65) Prior Publication Data

US 2024/0376890 A1 Nov. 14, 2024

Related U.S. Application Data

(60) Provisional application No. 63/501,941, filed on May 12, 2023.

(51) Int. Cl.
*F04B 43/107* (2006.01)
*F04B 47/04* (2006.01)
*F04B 53/08* (2006.01)

(52) U.S. Cl.
CPC ..... *F04B 43/107* (2013.01); *F04B 47/04* (2013.01); *F04B 53/08* (2013.01)

(58) Field of Classification Search
CPC ..... F04B 43/06–073; F04B 43/084; F04B 43/10–113; F04B 47/04; F04B 53/08
(Continued)

(56) References Cited

U.S. PATENT DOCUMENTS 1,256,127 A * 2/1918 Gould ..... F04B 43/107 92/39
1,301,485 A * 4/1919 Mueller ..... F04B 43/067 417/454

(Continued)

FOREIGN PATENT DOCUMENTS

CN 201982789 U 9/2011
CN 104763410 A 7/2015

(Continued)

OTHER PUBLICATIONS

First Office Action dated Mar. 12, 2025 (8 pages), U.S. Appl. No. 18/398,936, filed Dec. 28, 2023.

(Continued)

*Primary Examiner* — Alexander B Comley
(74) *Attorney, Agent, or Firm* — Conley Rose, P.C.; Rodney B. Carroll

(57) ABSTRACT

Exemplary systems may have a bellows pump and a make-up system, with the make-up system being configured to both keep the piston and bellows of the pump in sync and to cool fluid from at least one additional component of the system. In some embodiments, the make-up system may be configured as the sole cooling mechanism for the overall system, while in other embodiments the make-up system may work with one or more external cooler to jointly cool the overall system. In embodiments, the system may further include a control system which may be configured to determine and control appropriate fluid circulation, for example to optimize cooling as well as to maintain synchronous movement of the bellows and the piston. Related methods are also disclosed.

16 Claims, 11 Drawing Sheets

(58) Field of Classification Search
USPC ..... 417/383, 385–388, 390
See application file for complete search history.

(56) References Cited

U.S. PATENT DOCUMENTS 1,650,377 A * 11/1927 Nixon ..... F04B 43/067 417/571
1,832,257 A * 11/1931 Stephens ..... F04B 43/08 417/339
2,464,095 A * 3/1949 Nies ..... F04B 43/08 92/39
2,546,302 A 3/1951 Gehres et al.
2,613,607 A * 10/1952 Sheen ..... F04B 9/113 92/39
2,735,369 A * 2/1956 Turvey ..... F04B 43/009 92/38
2,807,215 A * 9/1957 Hawxhurst ..... F04B 49/121 417/388
3,134,508 A * 5/1964 Bayer ..... F04B 43/107 222/144.5
3,151,562 A * 10/1964 Swartz ..... F04B 43/107 92/144
3,192,860 A * 7/1965 Hardison ..... F04B 43/086 417/342
3,338,170 A * 8/1967 Swartz ..... F04B 43/107 417/388
3,411,452 A * 11/1968 Czarnecki ..... F04B 43/1136 417/388
3,433,161 A * 3/1969 Vetter ..... F04B 43/067 417/388
3,524,714 A * 8/1970 Grove ..... F04B 43/1136 417/345
3,680,981 A * 8/1972 Wagner ..... F04B 43/067 417/388
RE29,055 E * 11/1976 Wagner ..... F04B 43/067 417/388
4,003,679 A * 1/1977 McManigill ..... F04B 1/06 417/388
4,080,107 A * 3/1978 Ferrentino ..... H02G 15/26 417/388
4,406,595 A * 9/1983 Robertson ..... F04B 43/067 91/313
4,439,112 A * 3/1984 Kitsnik ..... F04B 9/107 91/275
4,442,957 A 4/1984 Neal et al.
4,594,057 A * 6/1986 Morgan ..... G01F 11/086 417/385
4,948,349 A * 8/1990 Koiwa ..... F04B 53/108 417/385
5,220,943 A * 6/1993 Zink ..... F04B 43/10 137/565.17
5,246,351 A * 9/1993 Horn ..... F04B 43/067 417/387
5,249,932 A * 10/1993 Van Bork ..... F04B 43/067 417/63
5,308,230 A * 5/1994 Moore ..... F04B 43/1136 417/394
6,419,462 B1 * 7/2002 Horie ..... F04B 43/073 417/394
6,554,578 B1 * 4/2003 Siegel ..... F04B 43/0081 417/383
9,243,413 B2 1/2016 Robol et al.
9,518,577 B2 * 12/2016 van Boeyen ..... F04B 43/1136
10,408,204 B2 * 9/2019 Suzuki ..... F04B 53/10
10,408,207 B2 9/2019 Yamada et al.
10,480,296 B2 11/2019 Beisel
10,895,254 B2 1/2021 Beisel
10,947,967 B1 3/2021 Surjaatmadja et al.
11,125,225 B2 9/2021 Beisel
11,268,502 B2 3/2022 Mollatt
11,286,920 B2 3/2022 Mollatt
11,346,336 B2 5/2022 Surjaatmadja et al.
11,401,792 B2 8/2022 Mollatt
11,415,123 B2 8/2022 Hunter et al.
2003/0031565 A1 * 2/2003 Kleibrink ..... F04B 45/0533 417/388
2006/0008364 A1 1/2006 Traylor
2007/0065305 A1 3/2007 Budde et al.
2007/0074872 A1 * 4/2007 Du ..... E21B 4/003 166/369
2008/0145248 A1 6/2008 Kato et al.
2009/0041588 A1 2/2009 Hunter et al.
2012/0091165 A1 4/2012 Cedrone et al.
2012/0308409 A1 12/2012 Levine
2015/0148919 A1 5/2015 Watson
2016/0097384 A1 4/2016 Menjoh et al.
2016/0123313 A1 * 5/2016 Simmons ..... F04B 9/133 417/392
2018/0313196 A1 * 11/2018 Frantz, III ..... F04B 53/10
2019/0383279 A1 12/2019 Simmons et al.
2020/0217186 A1 * 7/2020 Mollatt ..... F04B 9/00
2020/0256333 A1 8/2020 Surjaatmadja et al.
2020/0277951 A1 9/2020 Hunter et al.
2020/0309113 A1 10/2020 Hunter et al.
2021/0140294 A1 5/2021 Mollatt
2021/0148354 A1 * 5/2021 Adams ..... F04B 45/0533
2021/0173111 A1 6/2021 Therrien et al.
2021/0190065 A1 * 6/2021 Ferden ..... F04B 51/00
2021/0246894 A1 8/2021 Mollatt
2022/0178368 A1 6/2022 Montilla Jimenez et al.
2024/0376809 A1 11/2024 Hurst et al.
2024/0376881 A1 11/2024 Hurst et al.
2024/0376887 A1 11/2024 Hurst et al.
2025/0163784 A1 5/2025 Clyburn et al.

FOREIGN PATENT DOCUMENTS

CN 106761573 B 4/2019
DE 596227 C 7/1934
DE 2253288 A1 5/1974
DE 3706338 A1 * 9/1988 ..... F04B 43/067
EP 1602830 A1 * 12/2005 ..... F04B 43/113
EP 2913525 A1 * 9/2015 ..... F04B 45/0336
EP 4286688 A1 12/2023
FR 1441747 A 6/1966
FR 2367203 A2 5/1978
GB 2185291 A 7/1987
JP 6093190 A 5/1985
JP 1257775 A 10/1989
JP H11159464 A 6/1999
JP 2006200464 B2 8/2006
JP 2007100663 A 4/2007
KR 1020170016059 A 8/2018
SU 1359482 A1 * 12/1987
WO WO-2015078487 A1 * 6/2015 ..... F04B 45/033
WO 2022099219 A1 5/2022
WO WO-2022164034 A1 * 8/2022 ..... F04B 43/08

OTHER PUBLICATIONS

Foreign Communication from Related Application—International Search Report and Written Opinion of the International Searching Authority, International Application No. PCT/US2023/086404, dated Apr. 24, 2024, 10 pages.
Foreign Communication from Related Application—International Search Report and Written Opinion of the International Searching Authority, International Application No. PCT/US2023/086394, dated Apr. 24, 2024, 11 pages.
Foreign Communication from Related Application—International Search Report and Written Opinion of the International Searching Authority, International Application No. PCT/US2023/086395, dated Apr. 30, 2024, 11 pages.
Foreign Communication from Related Application—International Search Report and Written Opinion of the International Searching Authority, International Application No. PCT/US2023/086389, dated May 1, 2024, 11 pages.
Foreign Communication from Related Application—International Search Report and Written Opinion of the International Searching Authority, International Application No. PCT/US2023/086385, dated May 7, 2024, 11 pages.

(56) References Cited

OTHER PUBLICATIONS

Foreign Communication from Related Application—International Search Report and Written Opinion of the International Searching Authority, International Application No. PCT/US2023/086397, dated May 7, 2024, 10 pages.
Filing Receipt, Specification and Drawings for U.S. Appl. No. 18/398,858, filed Dec. 28, 2023, entitled "Bellows Failure Detection for a Pump," 70 pages.
Filing Receipt, Specification and Drawings for U.S. Appl. No. 18/398,878, filed Dec. 28, 2023, entitled "Direct Connect Piston-Driven Bellows Pump," 96 pages.
Filing Receipt, Specification and Drawings for U.S. Appl. No. 18/398,905, filed Dec. 28, 2023, entitled "Valve Monitoring System for a Bellows Pump," 91 pages.
Filing Receipt, Specification and Drawings for U.S. Appl. No. 18/398,923, filed Dec. 28, 2023, entitled "Active Bellows Pump Valve Management," 81 pages.
Filing Receipt, Specification and Drawings for U.S. Appl. No. 18/399,058, filed Dec. 28, 2023, entitled Protection of Make-Up System for High Pressure Bellows-Stylepump System, 91 pages.
Foreign Communication from Related Application—International Search Report and Written Opinion of the International Searching Authority, International Application No. PCT/US2023/086392, dated Apr. 19, 2024, 11 pages.
Filing Receipt, Specification and Drawings for U.S. Appl. No. 18/398,936, filed Dec. 28, 2023, entitled "Systems and Methods Using a Bellows Pump to Perform Operations for a Subterranean Formation," 81 pages.
First Office Action dated Apr. 28, 2025 (45 pages), U.S. Appl. No. 18/398,878, filed Dec. 28, 2023.
First Office Action dated Jul. 2, 2025 (40 pages), U.S. Appl. No. 18/398,905, filed Dec. 28, 2023.
First Office Action dated May 2, 2025 (28 pages), U.S. Appl. No. 18/398,923, filed Dec. 28, 2023.
First Office Action dated Jun. 2, 2025 (44 pages), U.S. Appl. No. 18/399,058, filed Dec. 28, 2023. 1.
Office Action dated Mar. 5, 20265 (20 pages), U.S. Appl. No. 18/398,858 filed Dec. 28, 2023.

* cited by examiner

COOLING FOR BELLOWS PUMP

CROSS-REFERENCE TO RELATED APPLICATIONS

This application claims priority benefit under 35 U.S.C. 119 (e) of U.S. Provisional Patent Application Ser. No. 63/501,941 (filed May 12, 2023), which is incorporated by reference herein in its entirety.

STATEMENT REGARDING FEDERALLY SPONSORED RESEARCH OR DEVELOPMENT

Not applicable.

FIELD

This disclosure relates generally to the field of pumping, for example pumping of fluids downhole in a well. More particularly, this disclosure relates to systems and methods relating to bellows pumps.

BACKGROUND

To produce hydrocarbons (for example, oil, gas, etc.) from a subterranean formation, wellbores may be drilled that penetrate hydrocarbon-containing portions of the subterranean formation. The portion of the subterranean formation from which hydrocarbons may be produced is commonly referred to as a "production zone." In some instances, a subterranean formation penetrated by the wellbore may have multiple production zones at various locations along the wellbore.

Generally, after a wellbore has been drilled to a desired depth, completion operations are performed. Such completion operations may include inserting a liner or casing into the wellbore and, at times, cementing the casing or liner into place. Once the wellbore is completed as desired (lined, cased, open hole, or any other known completion), treatment, such as a stimulation operation, may be performed to enhance hydrocarbon production into the wellbore. Examples of some common stimulation operations involve hydraulic fracturing, acidizing, fracture acidizing, and hydro-jetting. Stimulation operations are intended to increase the flow of hydrocarbons from the subterranean formation surrounding the wellbore into the wellbore itself so that the hydrocarbons may then be produced up to the wellhead.

One typical formation stimulation process may involve hydraulic fracturing of the formation and placement of a proppant in those fractures. Typically, a treatment/stimulation fluid (which may comprise a clean fluid and a proppant) may be mixed at the surface before being pumped downhole in order to induce fractures or perforations in the formation of interest. The creation of such fractures or perforations will increase the production of hydrocarbons by increasing the flow paths into the wellbore.

Various types of pumps have been used in well operations such as hydraulic fracturing. However, given the difficult conditions and related wear and reliability issues that may arise when pumping treatment fluids for a hydrocarbon well, there is need for improved pumps and related systems and methods.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
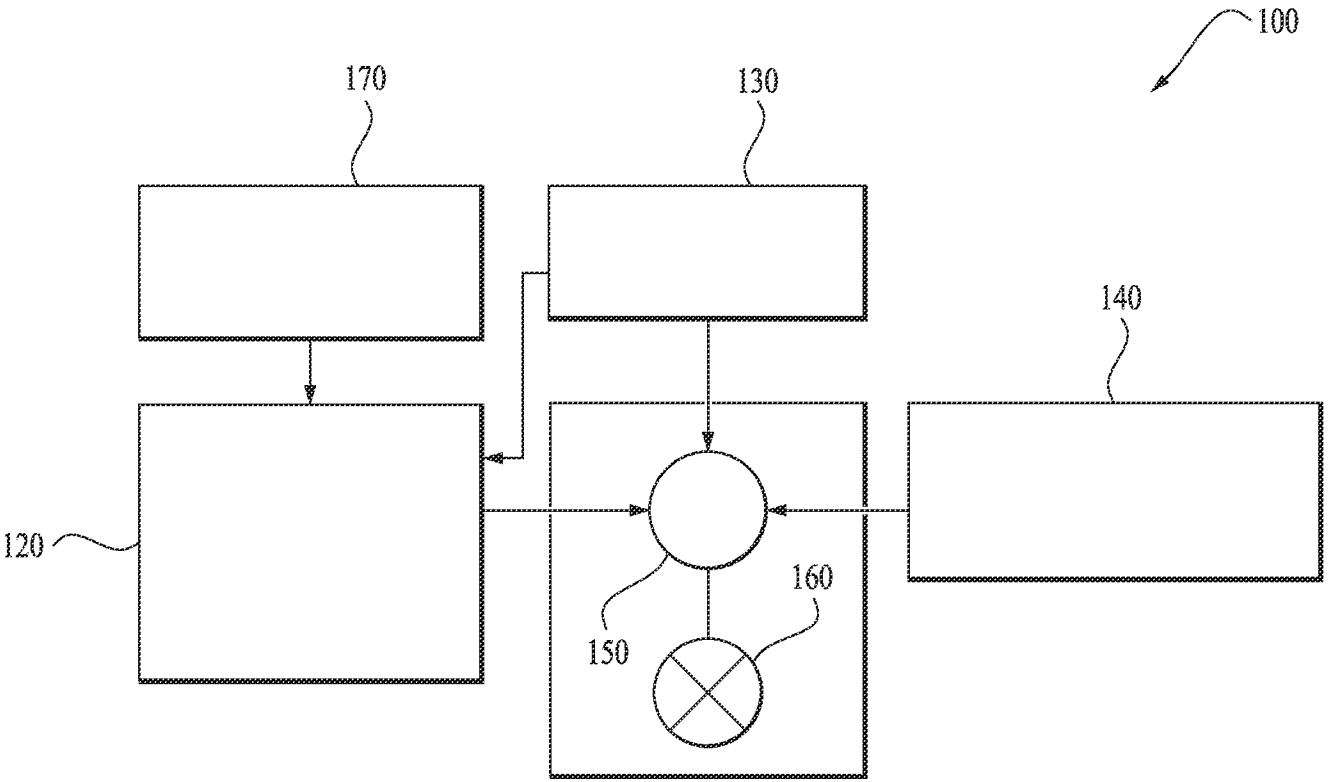
FIG. 1 is a schematic illustration of an exemplary well treatment system, such as an exemplary fracturing system, according to an embodiment of the disclosure.

It should be understood at the outset that although illustrative implementations of one or more embodiments are illustrated below, the disclosed systems and methods may be implemented using any number of techniques, whether currently known or not yet in existence. The description that follows includes example systems, methods, techniques, and program flows that embody aspects of the disclosure. However, it is understood that this disclosure may be practiced without these specific details. For brevity, well-known steps, protocols, structures, and techniques have not been shown in detail in order not to obfuscate the description. The disclosure should in no way be limited to the illustrative implementations, drawings, and techniques illustrated below, but may be modified within the scope of the appended claims along with their full scope of equivalents.

As used herein the terms "uphole", "upwell", "above", "top", and the like refer directionally in a wellbore towards the surface, while the terms "downhole", "downwell", "below", "bottom", and the like refer directionally in a wellbore towards the toe of the wellbore (e.g. the end of the wellbore distally away from the surface), as persons of skill will understand. Orientation terms "upstream" and "downstream" are defined relative to the direction of flow of fluid. "Upstream" is directed counter to the direction of flow of fluid, while "downstream" is directed in the direction of flow of fluid, as persons of skill will understand.

Disclosed embodiments illustrate exemplary devices, systems, and methods for using treatment fluids to carry out subterranean treatments in conjunction with a variety of subterranean operations, including but not limited to, hydraulic fracturing operations, fracturing acidizing operations to be followed with proppant hydraulic fracturing operations, stimulation treatments, drilling, cementing, and the like. For example, treatment fluid may be introduced into a wellbore (e.g. which penetrates a subterranean formation) at a pressure sufficient to create or enhance one or more fractures within the subterranean formation (for example, hydraulic fracturing) and/or to create or enhance and treat microfractures within a subterranean formation in fluid communication with a primary fracture in the formation. In one or more embodiments, the systems and methods of the present disclosure may be used to treat pre-existing fractures, or fractures created using a different treatment fluid. In one or more embodiment, a treatment fluid may be introduced at a pressure sufficient to create or enhance one or more fractures within the formation, and/or one or more of the treatment fluids may include a proppant material which subsequently may be introduced into the formation. In embodiments, treatment fluid can be any fluid (and may in some instances include solid particles therein) which can be pumped into a well. In embodiments, treatment fluid may differ from drive fluid used within a pump mechanism.

By way of example, FIG. 1 schematically illustrates an exemplary fracturing system 100. The fracturing system 100 may be implemented using the systems, methods, and techniques described herein. In particular, the disclosed systems, methods, and techniques may directly or indirectly affect one or more components or pieces of equipment associated with the example fracturing system 100, according to one or more embodiments. In embodiments, the fracturing system 100 may comprise one or more of the following: a fracturing fluid producing apparatus 120, a fluid source 130, a solid source 140, an additive source 170, and a pump and blender system 150. All or an applicable combination of these components of the fracturing system 100 may reside at the surface at a well site/fracturing pad where a well 160 can be located.

During a fracturing job, the fracturing fluid producing apparatus 120 may access the fluid source 130 for introducing/controlling flow of a fluid, e.g. a treatment fluid such as fracturing fluid, in the fracturing system 10. While only a single fluid source 130 is shown, the fluid source 130 may include a plurality of separate fluid sources (e.g. storage tanks). In some embodiments, the fracturing fluid producing apparatus 120 may be omitted from the fracturing system 100, with the fracturing fluid instead being sourced directly from the fluid source 130 during a fracturing job rather than through the intermediary fracturing fluid producing apparatus 120.

The fracturing fluid may be an applicable fluid for forming fractures during a fracture stimulation treatment of the well 160. For example, the fracturing fluid may include water, a hydrocarbon fluid, a polymer gel, foam, air, wet gases, and/or other applicable fluids. In various embodiments, the fracturing fluid may include a concentrate to which additional fluid is added prior to use in a fracture stimulation of the well 160. In certain embodiments, the fracturing fluid may include a gel pre-cursor with fluid, e.g. liquid or substantially liquid, from fluid source 130. Accordingly, the gel pre-cursor with fluid may be mixed by the fracturing fluid producing apparatus 120 to produce a hydrated fracturing fluid for forming fractures.

The solid source 140 may include a volume of one or more solids which may be mixed with a fluid, e.g. the fracturing fluid, to form a solid-laden fluid. The solid-laden fluid may be pumped into the well 160 as part of a solid-laden fluid stream that is used to form and stabilize fractures in the well 160 during a fracturing job. The one or more solids within the solid source 140 may include applicable solids that may be added to the fracturing fluid of the fluid source 130. Specifically, the solid source 140 may contain one or more proppants for stabilizing fractures after they are formed during a fracturing job, e.g. after the fracturing fluid flows out of the formed fractures. For example, the solid source 140 may contain sand.

The fracturing system 100 may also include an additive source 170. The additive source 170 may contain/provide one or more applicable additives that may be mixed into fluid, e.g. the fracturing fluid, during a fracturing job. For example, the additive source 170 may include solid-suspension-assistance agents, gelling agents, weighting agents, and/or other optional additives to alter the properties of the fracturing fluid. The additives may be included in the fracturing fluid to reduce pumping friction, to reduce or eliminate the fluid's reaction to the geological formation in which the well is formed, to operate as surfactants, and/or to serve other applicable functions during a fracturing job. As will be discussed in greater detail later, the additives may function to maintain solid particle suspension in a mixture of solid particles and fracturing fluid as the mixture is pumped down the well 160 to one or more perforations.

The pump and blender system 150 functions to pump treatment fluid into the well 160. Specifically, the pump and blender system 150 of FIG. 1 may pump fracture fluid from the fluid source 130, e.g. fracture fluid that is received through the fracturing fluid producing apparatus 120, into the well 160 for forming and potentially stabilizing fractures as part of a fracture job. The pump and blender system 150 may include one or more pumps. Specifically, the pump and blender system 150 may include a plurality of pumps that may operate together, e.g. concurrently, to form fractures in a subterranean formation as part of a fracturing job. The one or more pumps included in the pump and blender system 150 may be any applicable type of fluid pump. For example, the pumps in the pump and blender system 150 may include electric pumps and/or hydrocarbon and hydrocarbon mixture powered pumps, such as diesel-powered pumps, natural gas-powered pumps, and diesel combined with natural gas-powered pumps. In one or more embodiments, one or more of the pumps in the pump and blender system 150 may be a bellows pump.

In some embodiments, the pump and blender system 150 may also function to receive the fracturing fluid and combine it with other components and solids (e.g. with the pump and blender system 150 optionally comprising a blender unit). Specifically, the pump and blender system 150 may combine the fracturing fluid with volumes of solid particles, e.g. proppant, from the solid source 140 and/or additional fluid and solids from the additive source 170. In turn, the pump and blender system 150 may pump the resulting mixture down the well 160 at a sufficient pumping rate to create or enhance one or more fractures in a subterranean zone, for example, to stimulate production of fluids from the zone. While the pump and blender system 150 is described to perform both pumping and mixing of fluids and/or solid particles, in various embodiments, the pump and blender system 150 may function to just pump a fluid stream, e.g. a treatment and/or fracture fluid stream, down the well 160 to create or enhance one or more fractures in a subterranean zone. In some embodiments, a separate pump and/or separate blender may be used (e.g. independently of each other or alone).

In embodiments, one or more elements/components of the system may be monitored (e.g. using one or more sensor). For example, the fracturing fluid producing apparatus 120, fluid source 130, and/or solid source 140 may be equipped with one or more monitoring devices (not shown). The monitoring devices may be used to control the flow of fluids, solids, and/or other compositions to the pumping and blender system 150. Such monitoring devices may effectively allow the pumping and blender system 150 to source from one, some, or all of the different sources at a given time. In turn, the pumping and blender system 150 may provide just fracturing fluid into the well 160 at some times, just solids or solid slurries at other times, and combinations of those components at other times.

Figure 2:
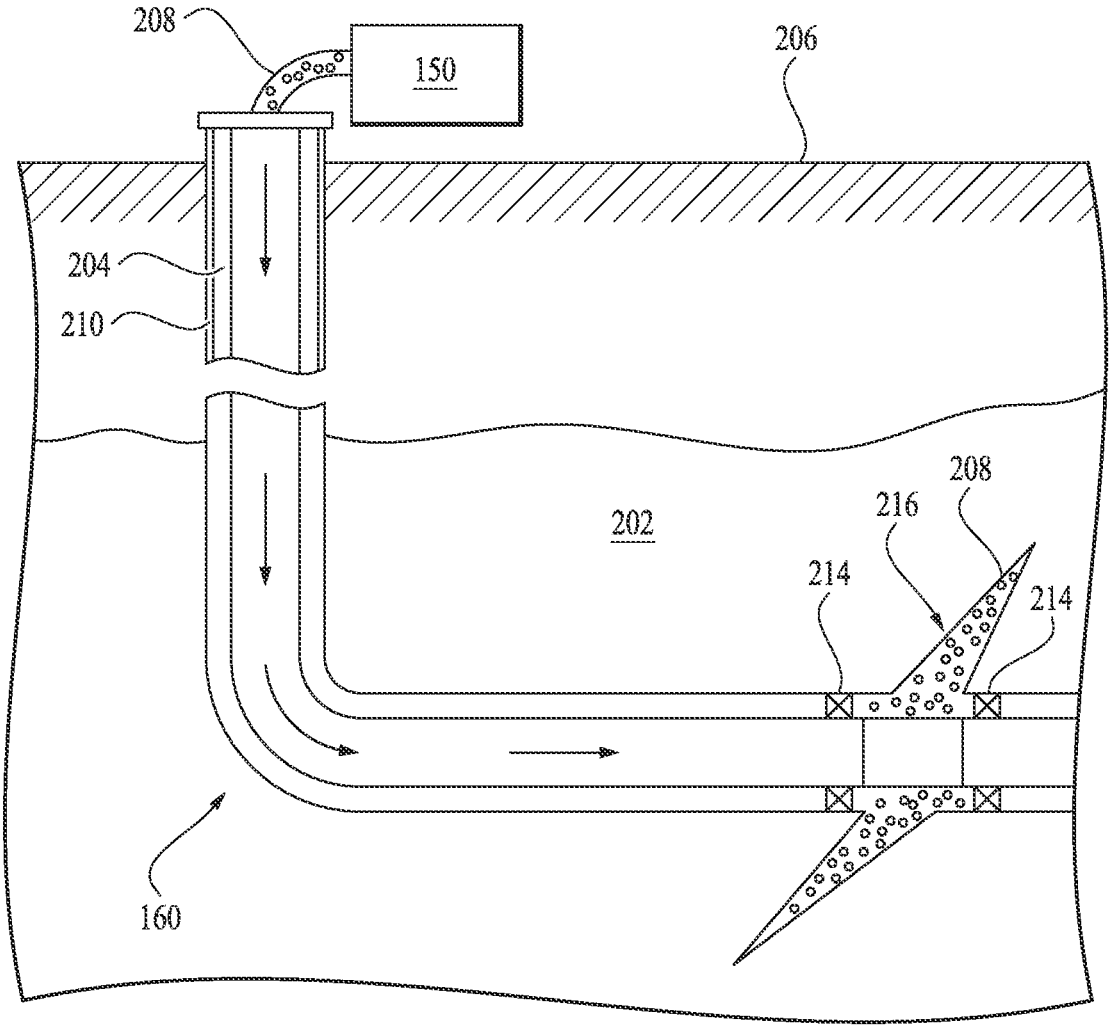
FIG. 2 is a schematic illustration of an exemplary well during a treatment operation, according to an embodiment of the disclosure.

FIG. 2 illustrates an exemplary well 160 during a treatment operation (e.g. a fracturing operation) in a portion of a subterranean formation of interest 202 surrounding a wellbore 204. In embodiments, the downhole operation may be performed using one or an applicable combination of the components in the example system 100 shown in FIG. 1. The wellbore 204 of FIG. 2 extends from a surface 206, and a fracturing fluid 208 is applied to a portion of the subterranean formation 202 (e.g. surrounding the horizontal portion of the wellbore 204). Although shown as vertical deviating to horizontal, the wellbore 204 may include horizontal, vertical, slant, curved, and other types of wellbore geometries and orientations, and the fracturing treatment may be applied to a subterranean zone surrounding any portion of the wellbore 204. The wellbore 204 may include a casing 210 that is cemented or otherwise secured to the wellbore wall. The wellbore 204 may be uncased or otherwise include uncased sections. Perforations may be formed in the casing 210 to allow fracturing fluids and/or other materials to flow into the subterranean formation 202. In the example fracture operation shown in FIG. 2, a perforation is created between points 214 (which may represent one or more packer element in some embodiments) defining an isolated zone.

The pump and blender system 150 (or in some embodiments, just a pump or a separate pump and a separate blender) may be fluidly coupled to the wellbore 204 to pump treatment fluid (e.g. fracturing fluid 208), and potentially other applicable solids and solutions, into the wellbore 204. When the fracturing fluid 208 is introduced into wellbore 204, it may flow through at least a portion of the wellbore 204 to the perforation, for example defined by points 214 in FIG. 2. The fracturing fluid 208 may be pumped at a sufficient pumping rate through at least a portion of the wellbore 204 to create one or more fractures 216 through the perforation and into the subterranean formation 202. Specifically, the fracturing fluid 208 may be pumped at a sufficient pumping rate to create a sufficient hydraulic pressure at the perforation to form the one or more fractures 216. Further, solid particles, e.g. proppant from the solid source 140, may be pumped into the wellbore 204, e.g. within the fracturing fluid 208 towards the perforation. In turn, the solid particles may enter the fractures 216 where they may remain after the fracturing fluid flows out of the wellbore. These solid particles may stabilize or otherwise "prop" the fractures 216, such that fluids may flow freely through the fractures 216.

While only two perforations at opposing sides of the wellbore 204 are shown in FIG. 2, greater than two perforations may be formed in the wellbore 204 as part of a perforation cluster. Fractures may then be formed through the plurality of perforations in the perforation cluster as part of a fracturing stage for the perforation cluster. Specifically, fracturing fluid and solid particles may be pumped into the wellbore 204 and pass through the plurality of perforations during the fracturing stage to form and stabilize the fractures through the plurality of perforations.

The pump and blender system 150 may comprise a pump (e.g. a high-pressure pump), which may be used, either alone or in combination with one or more other pumps, to pressurize a treatment fluid and/or introduce the treatment fluid into wellbore 204 penetrating at least a portion of a subterranean formation to perform a treatment therein. For example, in hydraulic fracturing operations, one or more pumps may be used to pump a treatment fluid (e.g. fracturing fluid 208, which typically may be a slurry mixture of proppant and/or sand mixed with water) into the formation.

In some embodiments, the pump may comprise a bellows pump 300, which may be configured to segregate treatment fluid from drive fluid (sometimes termed power fluid). See for example FIG. 3, which schematically illustrates a bellows pump 300. The bellows pump 300 may comprise a power end 310, a fluid end 320, and an expandable bellows 330. The fluid end 320 may have a chamber 321 within a fluid end housing 323, a suction valve 326 in fluid communication with (e.g. fluidly coupled to) the chamber 321 and a source/reservoir for the treatment fluid 350 (e.g. with the suction valve 326 being configured to allow for insertion of treatment fluid into the chamber 321), and a discharge valve 328 in fluid communication with (e.g. fluidly coupled to) the chamber 321 and the well (e.g. with the discharge valve 328 being configured to allow for insertion of treatment fluid from the chamber 321 into the well or any other place where treatment fluid is intended to be pumped). While the suction valve 326 and discharge valve 328 may be disposed within the housing 323 for the fluid end 320 in some embodiments, in other embodiments, the suction valve 326 and discharge valve 328 may be located within other components (such as piping) that fluidly couples the valves to the elements/components of the pump 300 as described.

In embodiment, the power end 310 may be fluidly connected to (e.g. in fluid communication with) the bellows 330 (e.g. the inner volume of the bellows) and/or configured to reciprocally expand/inflate and contract/deflate the bellows 330 based on movement of drive fluid 311 (sometimes termed power fluid). The bellows 330 may be configured to reciprocally expand and/or retract within the chamber 321 of the fluid end 320 based on movement of the drive fluid 311. In some embodiments, the bellows 330 may be sealingly coupled to an opening in the chamber 321 of the fluid end 320 (e.g. coupled to the wall of the chamber), so that fluid communication between the power end 310 and the bellows 330 causes reciprocal movement of the bellows 330 within the chamber 321. In some embodiments, the power end 310 may be (e.g. sealingly) coupled to the fluid end 320, with no flow of treatment fluid or drive fluid therebetween (e.g. since the bellows 330 separates the fluids).

In embodiments, the bellows 330 may comprise a flexible/expandable bag or body, typically of thin, flexible material, whose inner volume (e.g. the open space therein, which may be configured to hold drive fluid) can be changed (e.g. based on the amount/pressure of fluid therein). The bellows 330 may have an opening allowing fluid communication of drive fluid 311 with the power end 310, but in some embodiments may otherwise have a form configured to retain fluid therein. For example, the bellows 330 may be configured to prevent fluid transfer between its interior and the chamber 321 of the fluid end 320 external to the bellows 330. In some embodiments, the bellows 330 may comprise an elastomeric element and/or material. In some embodiments, the bellows 330 may comprise metal material and/or may include an accordion-like configuration (e.g. having pleats or folds or convolutions). In some embodiments, exemplary metal bellows may be formed of a metal that is sufficiently flexible and/or durable and configured appropriately to effectively withstand repeated back and forth motion due to reciprocal movement without breaking or wearing to failure for a reasonable life of the bellows. For example, the bellows may comprise stainless steel, nickel alloys such as Inconel & Monel, hastealloy, and/or copper alloys. In some embodiments, the bellows 330 may not be configured to withstand significant pressure differentials. In some embodiments, the bellows 330 may be configured to separate (e.g. isolate) drive fluid 311 (e.g. clean fluid) from treatment fluid (e.g. dirty fluid, such as fluid having proppant, abrasives, and/or corrosive materials, such as from treatment fluid source 350).

The bellows 330 may be disposed in and/or configured to expand into the chamber 321 of the fluid end 320, and may be configured to serve as a separating barrier that divides the chamber 321 into a first volume 373 within the bellows 330 and a second volume 375 outside of the bellows 330. The first volume 373 (e.g. inner volume of the bellows 330) may be in fluid communication with the power end 310, and may in some embodiments contain drive fluid. The second volume 375 of the chamber 321 is in fluid communication with the suction valve 326 and discharge valve 328, and is configured for treatment fluid to flow therethrough. The bellows 330 may serve as a fluid separating barrier between the drive fluid 311 in the first volume 373 and the treatment fluid in the second volume 375. The bellows 330 may be configured to flex (e.g. expand and/or contract) to balance pressure between the first volume 373 and second volume 375 during operation of the pump 300. In some embodiments, the bellows 330 may be configured to flex axially. The power end 310 of pump 300 may be sealingly connected to the fluid end 320, to prevent entry of treatment fluid from the fluid end 320 into the power end 310.

The chamber 321 may be downstream of the fluid treatment source 350 and upstream of the well 160. Typically, the suction valve 326 can be a one-way check valve configured to allow treatment fluid from the treatment fluid source 350 to enter the chamber 321 (e.g. during a suction stroke of the pump 300), and the discharge valve 328 can be a one-way check valve configured to allow treatment fluid to exit the chamber 321 towards the well (e.g. during a power/discharge stroke of the pump 300). The reciprocating expansion and retraction of the bellows 330 in the chamber 321 (e.g. with the bellows 330 expanding/inflating for the discharge stroke and contracting/deflating for the suction stroke) can be configured to work in conjunction with the suction valve 326 and discharge valve 328 to allow the fluid end 320 to pump treatment fluid into the well 160. For example, during a discharge stroke, as drive fluid 311 enters the first volume 373 (e.g. the inner volume of the bellows 330), the bellows 330 inflates and treatment fluid is expelled from the second volume 375 of the chamber 321 through the discharge valve 328. Once the discharge stroke is complete, a suction stroke can begin. During the suction stroke, drive fluid 311 inside the first volume 373 exits the bellows 330, the bellows 330 deflates, and treatment fluid can be drawn through the suction valve 326 into the second volume 375 of the chamber 321. Once the bellows 330 is compressed to its minimum desired/permitted length, another discharge stroke can begin.

The bellows 330 may be configured to separate treatment fluid, which the pump 300 may be pumping into the well 160, from drive fluid 311 used for pump operations. By way of example, the drive fluid 311 may be chosen from a desirable group of liquids, which may include hydraulic fluid such as water or hydraulic oil. In some embodiments, the drive fluid 311 may also serve as a lubricant for the pump 300, for example forming a barrier against wear due to friction. In the case of a fracturing operation or a fracturing pump, the treatment fluid may be a fracturing fluid that may comprise a base fluid (e.g., water, oils, organic liquids, etc.) as well as any other suitable components or additives useful for the fracturing treatment. For example, the fracturing fluid may be a slurry containing sand or synthetic proppants and/or a variety of chemical additives such as gelling agents, acids, friction reducers, and solvents.

In various embodiments, any mechanism for causing reciprocal movement of the bellows 330 (e.g. by movement of the drive fluid 311) can provide the pumping action for the pump 300. In some embodiments, the power end 310 may further comprise a piston or plunger 410 configured to reciprocally move drive fluid 311 (e.g. in and out of the bellows 330). See for example FIG. 4, which schematically illustrates an embodiment of the bellows pump 300 having a piston/plunger 410. Reciprocal movement (e.g. axial translation) of the piston/plunger 410 within a bore 420 of the power end housing 413 may cause the reciprocal movement (e.g. expanding and contracting) of the bellows 330 (e.g. within the chamber 321 of the fluid end 320), for example with the piston/plunger 410 displacing fluid (e.g. hydraulic drive fluid 311) which is located in the bore 420 between the driven end of the piston/plunger 410 (e.g. the end in proximity to the bellows 330) and the bellows 330. Since the bore 420 is fluidly coupled to (e.g. in fluid communication with) the bellows 330, the piston/plunger 410 reciprocally displacing drive fluid 311 can induce reciprocal movement (e.g. expansion and contraction) of the bellows 330. As used herein, reference to "piston" shall include both conventional piston and plunger elements for convenience of reference.

Figure 4:
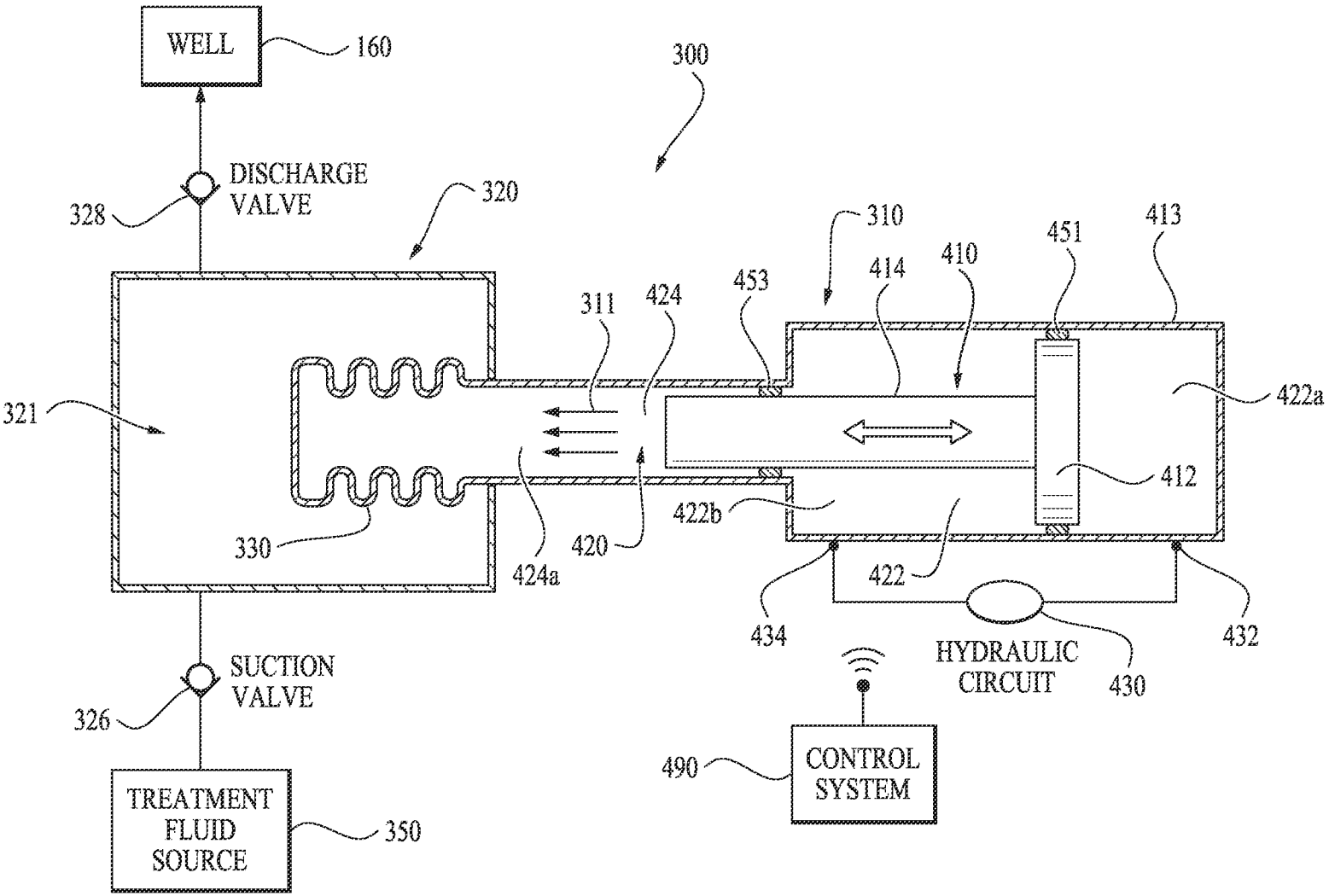
FIG. 4 is a schematic illustration of an exemplary bellows pump with piston/plunger, according to an embodiment of the disclosure.

In embodiments, the piston 410 may be configured to sealingly move within the bore 420, for example having one or more seal (configured to engage between the piston 410 and the bore 420) disposed on the piston 410 and/or on the inner wall of the bore 420. In some embodiments, one or more seal may comprise pump packing. In some embodiments, the bellows 330 may be configured to protect the piston 410 from wear, for example by separating the piston 410 from the treatment fluid in the fluid end 320. In some embodiments, the piston 410 may be configured so that, during its reciprocal movement in the bore 420, the piston 410 does not extend into the inner volume of the bellows 330; while in other embodiments, the piston 410 may be configured to extend partially into the bellows during a discharge stroke. Regardless, the piston 410 may be configured to not contact the bellows 330 (e.g. the end of the bellows) during its reciprocal movement. The piston 410 can be driven/powered by any suitable means, including various types of driver elements configured to induce reciprocal movement of the piston 410, such as a hydraulic circuit, a combustion engine, an electric motor, a linear actuator, rack and pinion, etc. In the example of FIG. 4, the piston 410 may be driven by a hydraulic circuit 430. In other exemplary embodiments, the pump 300 may be powered by natural gas (e.g. via a natural gas-fired engine or natural gas-fired electric generator) produced from the same area in which well treatment (e.g. fracturing) operations are being performed. In some embodiments, a control system 490 may control one or more aspect of the driver (e.g. to control the reciprocation of the piston 410 and thereby the bellows 330) and/or the valves (e.g. 326, 328).

In some embodiments, the piston 410 can comprise a head 412 and a rod 414 (e.g. with the rod 414 disposed between the head 412 and the bellows 330, and extending from the head 412 towards the fluid end 320). In some embodiments, the piston 410 can be driven by a hydraulic circuit 430. For example, the hydraulic circuit 430 of the power end 310 can include a first port 432, located such that the head 412 is disposed between the first port 432 and the rod 414, and a second port 434 located between the head 412 and the bellows 330 (e.g. more proximate the bellows 330 than the first port 432). In some embodiments, the hydraulic circuit 430 may include one or more source of drive fluid and/or one or more pump. For example, the first port 432 may be in fluid communication with a source of drive fluid and/or a pumping mechanism. In some embodiments, the second port 434 may be in fluid communication with a source of drive fluid and/or a pumping mechanism. In some embodiments, the source of drive fluid may be the same for the first port 432 and the second port 434. In some embodiments, the pumping mechanism may be the same for the first port 432 and the second port 434. In some embodiments, the hydraulic circuit 430 may include one or more valve. The hydraulic circuit 430 may be configured to produce pressure differential on either side of the piston 410 (e.g. the head 412), for example by introducing drive fluid (such as hydraulic oil) via the ports (432, 434), which may induce movement/displacement of the piston 410. For example, introducing drive fluid via the first port 432 and/or removing drive fluid via the second port 434 may urge extension of the piston 410 towards the fluid end 320, while introducing drive fluid via the second port 434 and/or removing drive fluid via the first port 432 may retract the piston 410, urging the piston 410 away from the fluid end 320.

While the rod 414 and head 412 may have a similar diameter in some embodiments, in some embodiments the rod 414 may have a smaller diameter than the head 412. The ratio of size differential between the rod 414 and the head 412 can provide an intensifying effect, in which pressure applied to the head 412 is multiplied/increased as applied to the bellows 330 (via the rod 414). For example, the piston 410 may be part of an intensifier configured to intensify applied pressure (e.g. from the driver) to the bellows 330 (e.g. with the rod 414 having a smaller diameter than the head 412). For example, the size difference/ratio between the diameter of the rod 414 and the head 412 may range from approximately 1:1.1 to 1:10 (e.g. from 1:1.5 to 1:10, from 1:2 to 1:10, from 1:3 to 1:10, from 1:5 to 1:10, from 1:7 to 1:10, from 1:1.5 to 1:8, from 1:1.5 to 1:5, from 1:1.5 to 1:3, from 1:2 to 1:8, from 1:2 to 1:5, from 1:2 to 1:3, from 1:3 to 1:10, from 1:3 to 1:8, or from 1:3 to 1:5).

As described above, the power end 310 may include a bore 420 (e.g. in a power end housing 413) in fluid communication with (e.g. fluidly coupled to) the bellows 330 (e.g. an internal volume of the bellows), and the piston 410 can be disposed within the bore 420. In embodiments (e.g. in which the piston 410 is not uniform in diameter along its length), the bore 420 may have a first portion 422 with an inner diameter configured for movement of the head 412 (axially) therethrough and a second portion 424 with an inner diameter configured for movement of the rod 414 (axially) therethrough. For example, the first portion 422 of the bore may have a diameter approximately equal to that of the head 412, while the second portion 424 of the bore may have a diameter approximately equal to that of the rod 414 (e.g. the first portion 422 of the bore may have a larger diameter than the second portion 424 of the bore). In embodiments, the head 412 may separate the first portion 422 of the bore 420 into two cavities (whose volumes may change based on the position of the head 412 within the bore 420), for example with a first cavity 422*a* distally away from the fluid end 320 and/or bellows 330 (e.g. with the head 412 disposed between the first cavity 422*a* and the bellows 330) and a second cavity 422*b* more proximal to the bellows 330 and/or fluid end 320 (e.g. with the second cavity 422*b* disposed between the head 412 and the bellows 330). Interaction of the rod 414 within the second portion 424 of the bore 420 may form a third cavity 424*a* in fluid communication with the bellows 330. In embodiments having a hydraulic circuit as the driver (e.g. as shown in FIG. 4), the first port 432 may be in fluid communication with the first cavity 422*a*, and the second port 434 may be in fluid communication with the second cavity 422*b*. The third cavity 424*a* may be in fluid communication with the bellows 330. Typically, the bore 420 may extend along the longitudinal axis of the power end 310 and/or parallel to the longitudinal axis (e.g. the axis of extension) of the bellows 330.

In operation, the head 412 of the piston 410 may be configured to sealingly move within the first portion 422 of the bore 410 (e.g. during pump strokes), and the rod 414 may be configured to sealingly move within the second portion 424 of the bore 420 (e.g. during pump strokes). In embodiments, the power end 310 may further comprise a first seal 451 configured to seal the head 412 with respect to the first portion 422 of the bore 420 (e.g. such that the head 412 and first seal 451 isolate the first cavity 422*a* from the second cavity 422*b*) and a second seal 453 configured to seal the rod 414 with respect to the second portion 424 of the bore 420 (e.g. such that the rod 414 and second seal 453 isolate the third cavity 424*a* from the second cavity 422*b*). For example, the first seal 451 may be disposed on the head 412 (e.g. a moving seal), such as within one or more groove configured to hold a gasket, or on the bore first portion 422 inner surface (e.g. a stationary seal) and/or the second seal 453 may be disposed on the rod 414 (e.g. a moving seal) or on the bore second portion 424 inner surface (a stationary seal). In some embodiments, the first seal 451 may be a moving seal (e.g. disposed on the head 412) and the second seal 453 may be a stationary seal (e.g. disposed on the inner surface/wall of the bore 420—e.g. within the bore second portion 424—which may in some embodiments comprises pump packing). In some embodiments, one or more stationary seal may be configured to prevent fluid flow between the second portion 424 of the bore and the first portion 422 of the bore and/or to provide a controlled volume of fluid for interaction with the inner volume of the bellows 330. While the discussion has been set forth with regard to a pump 300 having a single bellows 330, similar concepts apply for dual (e.g. double-acting) bellows pumps (e.g. in which a single piston interacts with two bellows, for example such that the discharge stroke for one bellows is the suction stroke for the other).

It can be important for the health of the bellows pump 300 (e.g. to protect the bellows 330 from excessive pressure differentials which could damage the bellows 330) to ensure that the bellows 330 and the piston 410 remain in sync (e.g. with the bellows 330 not exceeding its full permissible extension position when the piston 410 is at its maximum extension at the end of the discharge stroke, and the bellows 330 not exceeding its permissible contraction position when the piston 410 is at its most retracted position at the end of its suction stroke). To aid in maintaining such synchronization between the bellows 330 and the piston 410, the volume of fluid between the rod 414 and the bellows 330 may be maintained at approximately a constant volume. Leaks in the bellows 330 can prove problematic, affecting the amount of sync and potentially damaging the bellows 330. For example, a bellows 330 leak can cause a pressure imbalance between the drive fluid in the bellows 330 and the treatment fluid in the chamber 321, which may damage (e.g. crush) the bellows 330.

Figure 5:
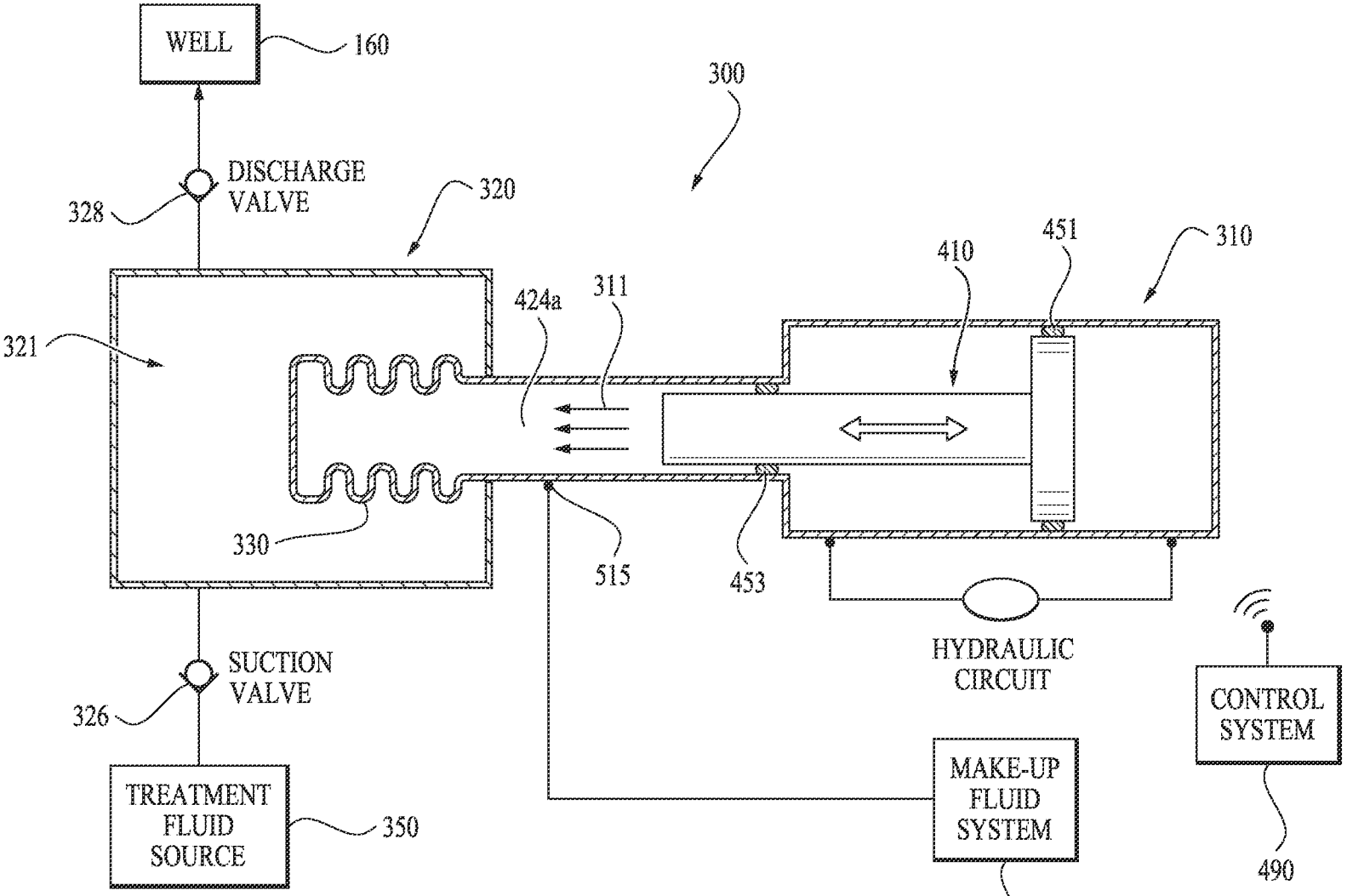
FIG. 5 is a schematic illustration of an exemplary system for providing make-up fluid to an exemplary bellows pump, according to an embodiment of the disclosure.

In order to address any such leak, a make-up system 510 (e.g. as shown schematically with an embodiment of pump 300 in FIG. 5) can be configured to correct/maintain a controlled volume of fluid in the space between the rod 414 and the bellows 330 (for example by injecting make-up fluid, which typically is drive fluid, into the space between the rod 414 and the bellows 330—e.g. into the sealed space formed by the rod seal 453, such as the third cavity 424*a*), in order to maintain synchronization between the bellows 330 and the piston 410. For example, the power end 310 may include a make-up port 515 (e.g. a third port), which may be in fluid communication with the second portion 424 of the bore 420 (e.g. the third cavity 424*a* between the rod 414 and/or rod seal 453 and the bellows 330). While the make-up port 515 is shown with respect to the power end 310 in FIG. 5, in other embodiments, the make-up port 515 may be disposed in the fluid end 320.

A source of make-up fluid may be in fluid communication with the make-up port 515, and the make-up system 510 may further comprise one or more make-up valve configured to open (to provide fluid communication therethrough) and close (to prevent fluid communication therethrough and/or isolate the make-up system 510 from the bellows 330). In some embodiments the make-up system 510 may include a make-up pump, which may be configured to pump make-up fluid from the make-up fluid source into the second portion 424 of the bore 420 through the make-up port 515. The control system 490 in some embodiments may be used to operate the make-up system 510, for example opening and closing the make-up valve and/or operating the make-up pump. In some embodiments, the control system 490 may comprise and/or communicate with one or more sensors, whose data the control system 490 can use to determine if the bellows 330 and piston 410 are out of sync and to operate the make-up system 510 to bring the bellows 330 and piston 410 back into sync. For example, the control system 490 may open the make-up valve and activate the make-up pump to inject make-up fluid into cavity 424*a* and/or to draw make-up fluid out of cavity 424*a* via make-up port 515, in order to bring the bellows 330 and the piston 410 back into sync.

In some embodiments, the pump 300 may be one of a plurality of similar pumps which may be configured to operate together/concurrently (e.g. configured to jointly pump fluid in the well 160 and/or which are jointly driven and/or which share a common drive fluid source and/or make-up fluid source and/or which are jointly controlled). For example, the plurality of pumps 330 may share a common source for treatment fluid, drive fluid, and/or make-up fluid. In some embodiments, the drive fluid and the make-up fluid may be drawn from a common fluid source (e.g. drive fluid and make-up fluid may be substantially the same). In some embodiments, the plurality of pumps 330 can share a common driver. In some embodiments, the plurality of pumps 330 may share a common control system 490. In some embodiments, one or more of the plurality of pumps 330 may be configured to be out-of-sync with one or more other of the plurality of pumps 330 (for example with a first pump undergoing a discharge stroke while a second pump undergoes a suction stroke). In some embodiments, having pumps of the plurality of pumps 330 out-of-sync with each other may allow for continuous pumping of treatment fluid (e.g. under approximately constant pressure). In some embodiments, a first half of the plurality of pumps may be in sync with each other, while a second half of the plurality of pumps may be in sync with each other but out of sync with the first half. In some embodiments, the plurality of pumps may comprise at least two dissimilar pumps.

Some embodiments may include a control system 490, which may be configured to monitor and/or control one or more aspects of the bellows pump 300 and/or related treatment system 100 (e.g. a system including at least one bellows pump 300). The control system 490 may include an information handling system (e.g. comprising one or more processor) and/or may be configured to receive data from one or more sensor configured to monitor/detect one or more parameters of the system. In some embodiments, the parameters monitored may include pressure, temperature, flow rate, viscosity, contamination/particle count, strain, valve position, piston position, and/or bellows position. Data from the sensor(s) may be transmitted to and/or received by the information handling system, for example with the control system 490 using the data to monitor and/or control one or more aspect of the bellows pump 300 and/or system 100. In embodiments, the control system 490 may be configured to communicate with sensors and/or other components of the pump or system wirelessly and/or via wired connection.

Figure 6:
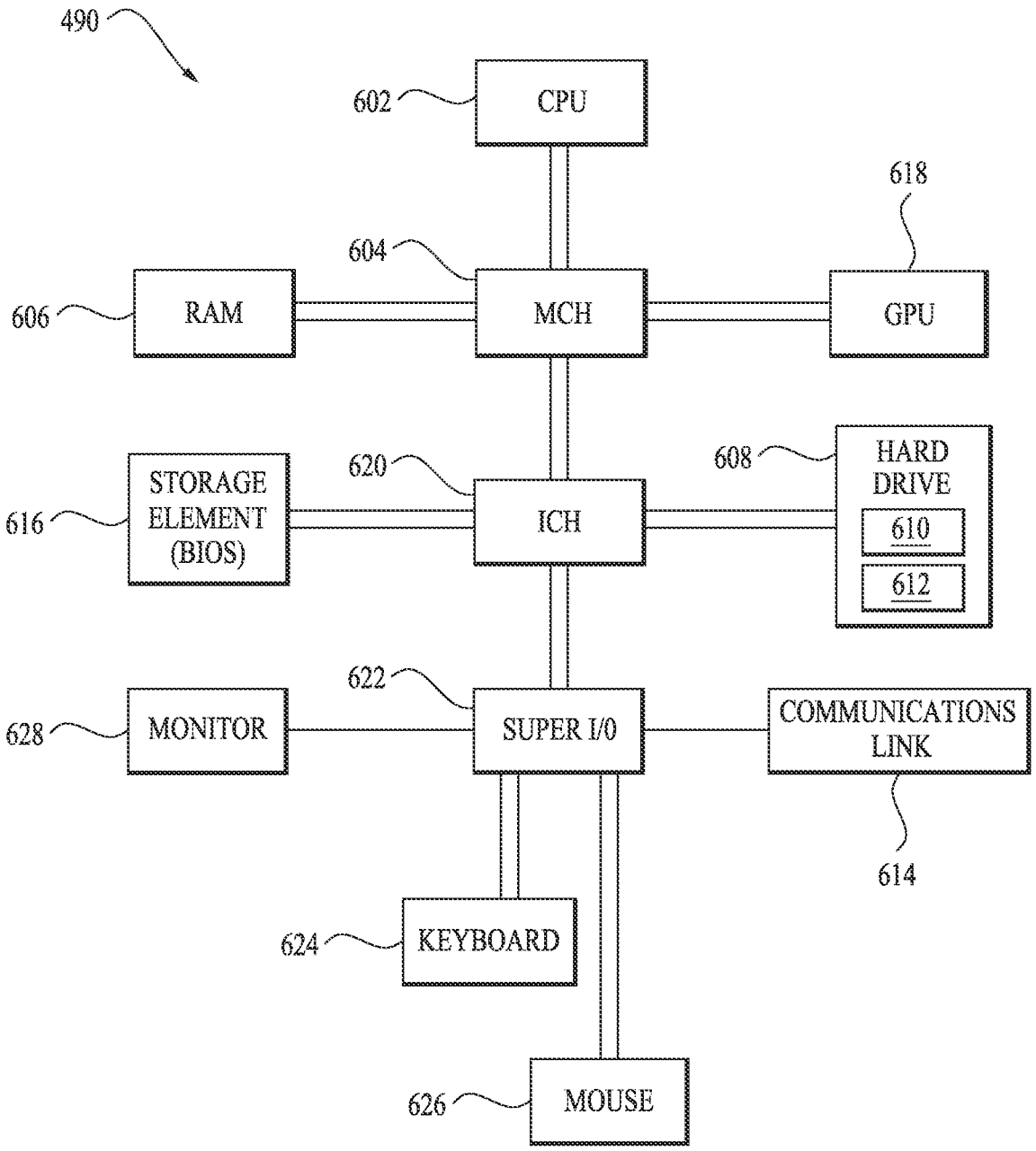
FIG. 6 is a schematic illustration of an exemplary control system, which may be used in conjunction with a bellows pump system, according to an embodiment of the disclosure.

FIG. 6 is a schematic diagram illustrating an exemplary information handling system/control system 490, for example for use with or by an associated treatment system 100 of FIG. 1, according to one or more aspects of the present disclosure. A processor or central processing unit (CPU) 602 of the control system 490 is communicatively coupled to a memory controller hub (MCH) or north bridge 604. The processor 602 may include, for example a microprocessor, microcontroller, digital signal processor (DSP), application specific integrated circuit (ASIC), or any other digital or analog circuitry configured to interpret and/or execute program instructions and/or process data. Processor 602 may be configured to interpret and/or execute program instructions or other data retrieved and stored in any memory (which may for example be a non-transitory computer-readable medium, configured to have program instructions stored therein, or any other programmable storage device configured to have program instructions stored therein) such as memory 606 or hard drive 608. Program instructions or other data may constitute portions of a software or application, for example application 610 or data 612, for carrying out one or more methods described herein. Memory 606 may include read-only memory (ROM), random access memory (RAM), solid state memory, or disk-based memory. Each memory module may include any system, device or apparatus configured to retain program instructions and/or data for a period of time (for example, non-transitory computer-readable media). For example, instructions from a software or application 610 or data 612 may be retrieved and stored in memory 606 for execution or use by processor 602. In one or more embodiments, the memory 606 or the hard drive 608 may include or comprise one or more non-transitory executable instructions that, when executed by the processor 602, cause the processor 602 to perform or initiate one or more operations or steps. The information handling system 600 may be preprogrammed or it may be programmed (and reprogrammed) by loading a program from another source (for example, from a CD-ROM, from another computer device through a data network, or in another manner).

The data 612 may include treatment data, geological data, fracture data, microseismic data, sensor data, or any other appropriate data. In one or more embodiments, the data 612 may include treatment data relating to fracture treatment plans. For example, the treatment data may indicate a pumping schedule, parameters of a previous injection treatment, parameters of a future injection treatment, or one or more parameters of a proposed injection treatment. Such one or more treatment parameters may include information on flow rates, flow volumes, slurry concentrations, fluid compositions, injection locations, injection times, or other parameters. The treatment data may include one or more treatment parameters that have been optimized or selected based on numerical simulations of complex fracture propagation. In one or more embodiments, the data 612 may include geological data relating to one or more geological properties of the subterranean formation 202 (referring to FIG. 2). For example, the geological data may include information on the wellbore 204 (referring to FIG. 2), completions, or information on other attributes of the subterranean formation 202. In one or more embodiments, the geological data may include information on the lithology, fluid content, stress profile (e.g., stress anisotropy, maximum and minimum horizontal stresses), pressure profile, spatial extent, or other attributes of one or more rock formations in the subterranean zone. The geological data may include information collected from well logs, rock samples, outcroppings, microseismic imaging, or other data sources. In one or more embodiments, the data 612 may include fracture data relating to fractures in the subterranean formation 202. The fracture data may identify the locations, sizes, shapes, and other properties of fractures in a model of a subterranean zone. The fracture data may include information on natural fractures, hydraulically-induced fractures, or any other type of discontinuity in the subterranean formation 202. The fracture data may include fracture planes calculated from microseismic data or other information. For each fracture plan, the fracture data may include information (for example, strike angle, dip angle, etc.) identifying an orientation of the fracture, information identifying a shape (for example, curvature, aperture, etc.) of the fracture, information identifying boundaries of the fracture, or any other suitable information.

In embodiments, the sensor data may include data measured/detected by one or more sensors, for example with relation to one or more aspect of the pump 300 and/or the system 100. For example, the sensor data may include pressure (e.g. at the fluid end 320 and/or the power end 310), temperature (e.g. at the fluid end 320 and/or power end 310 and/or make-up system 510), flow rate (e.g. within the fluid end 310 and/or hydraulic circuit 430 and/or the make-up system 510), viscosity (e.g. of treatment fluid in the fluid end 320 and/or drive fluid in the power end 310), contamination/particle count (e.g. at the fluid end 320 and/or power end 310 and/or in the make-up system 510), strain (e.g. at the fluid end 320 and/or power end 310), suction valve 326 and/or discharge valve 328 position, piston position, and/or bellows position. Data received by the control system 490 (e.g. from one or more sensors) may be used to carry out operations with respect to the pump 300 and/or system 100. For example, the control system 490 may evaluate the data and determine one or more action based on the evaluation. In some embodiments, the control system 490 may automatically take action based on the evaluation.

The one or more applications 610 may comprise one or more software applications, one or more scripts, one or more programs, one or more functions, one or more executables, or one or more other modules that are interpreted or executed by the processor 602. For example, the one or more applications 610 may include a fracture design module, a reservoir simulation tool, a hydraulic fracture simulation model, or any other appropriate function block. The one or more applications 610 may include machine-readable instructions for performing one or more of the operations related to any one or more embodiments of the present disclosure. The one or more applications 610 may include machine-readable instructions for generating a user interface or a plot, for example, illustrating fracture geometry (for example, length, width, spacing, orientation, etc.), pressure plot, hydrocarbon production performance, pump performance. The one or more applications 610 may obtain input data, such as treatment data, geological data, fracture data, or other types of input data, from the memory 606, from another local source, or from one or more remote sources (for example, via the one or more communication links 614). The one or more applications 610 may generate output data and store the output data in the memory 606, hard drive 608, in another local medium, or in one or more remote devices (for example, by sending the output data via the communication link 614).

Memory controller hub 604 may include a memory controller for directing information to or from various system memory components within the information handling system 600, such as memory 606, storage element 616, and hard drive 608. The memory controller hub 604 may be coupled to memory 606 and a graphics processing unit (GPU) 618. Memory controller hub 604 may also be coupled to an I/O controller hub (ICH) or south bridge 620. I/O controller hub 620 is coupled to storage elements of the information handling system 600, including a storage element 616, which may comprise a flash ROM that includes a basic input/output system (BIOS) of the computer system. I/O controller hub 620 is also coupled to the hard drive 608 of the information handling system 600. I/O controller hub 320 may also be coupled to an I/O chip or interface, for example, a Super I/O chip 622, which is itself coupled to several of the I/O ports of the computer system, including a keyboard 624, a mouse 626, a monitor (or other display) 628 and one or more communications link 614. Any one or more input/output devices receive and transmit data in analog or digital form over one or more communication links 614 such as a serial link, a wireless link (for example, infrared, radio frequency, or others), a parallel link, or another type of link. The one or more communication links 614 may comprise any type of communication channel, connector, data communication network, or other link. For example, the one or more communication links 614 may comprise a wireless or a wired network, a Local Area Network (LAN), a Wide Area Network (WAN), a private network, a public network (such as the Internet), a WiFi network, a network that includes a satellite link, or another type of data communication network.

Modifications, additions, or omissions may be made to FIG. 6 without departing from the scope of the present disclosure. For example, FIG. 6 shows a particular configuration of components of control system 490. However, any suitable configurations of components may be used. For example, components of control system 490 may be implemented either as physical or logical components. Furthermore, in some embodiments, functionality associated with components of control system 490 may be implemented in special purpose circuits or components. In other embodiments, functionality associated with components of control system 490 may be implemented in configurable general-purpose circuit or components. For example, components of control system 490 may be implemented by configured computer program instructions.

In certain piston-driven bellows-style pumps, keeping the piston and bellows in sync can be important (as discussed above). Accordingly, some embodiments of a bellows pump system may include a make-up system configured to maintain synchronous movement (for example, by maintaining a controlled volume of fluid between the piston and the bellows). In some embodiments, the make-up fluid of the make-up system may be shared by (e.g. in fluid communication with) one or more other/additional components of the bellows pump system, since the same fluid may be used for the make-up system as is used for operations of the pump itself or operations of other components of the system (for example using the fluid in hydraulic operations and/or as lubricant). This may lead to heat accumulation in the make-up system, which should be dissipated to keep the system operating effectively and to prevent damage to the system. Additionally, it may be advantageous to eliminate or to minimize the size/amount of external cooling systems needed to address heat issues for the system, since there is often a lack of space in proximity to well sites and/or since this may reduce cost, maintenance, size, supply issues, etc. Thus, there is a need for improved bellows pump systems configured to better handle heat build-up, for example in and/or using the make-up system.

Figure 3:
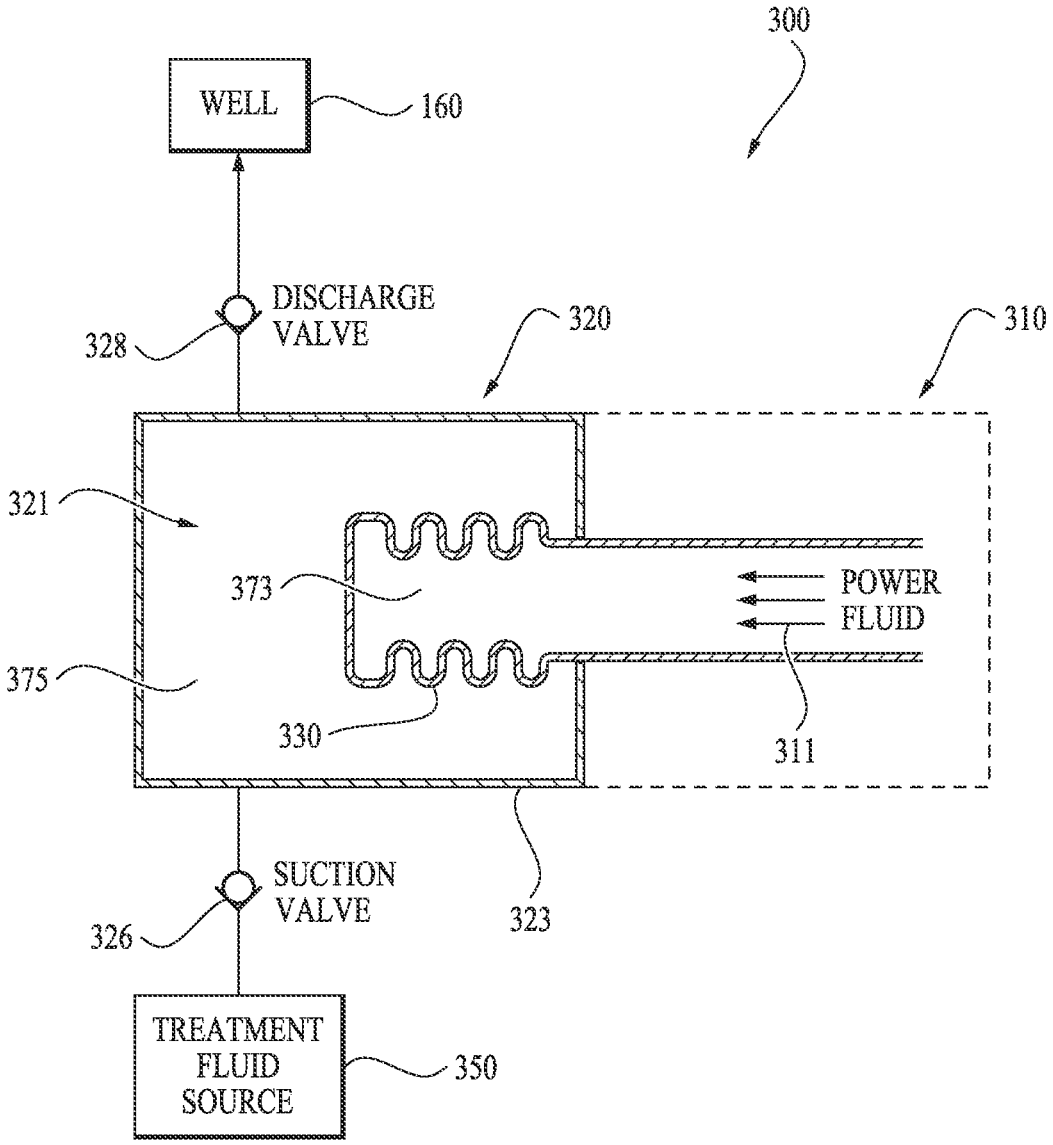
FIG. 3 is a schematic illustration of an exemplary bellows pump, according to an embodiment of the disclosure.

FIGS. 7-11 provide schematic illustration of exemplary bellows pump system embodiments having a bellows pump 300 similar to the pump embodiments shown in FIGS. 3-5, and having a make-up system 510 which can be configured to cool additional/other components of the system which may be in fluid communication with the make-up system 510. For example, disclosed embodiments may comprise a bellows pump 300 and a make-up system 510. In disclosed embodiments, the make-up system 510 can be configured to both keep the piston and bellows in sync (e.g. by maintaining a controlled volume of fluid (e.g. make-up/drive fluid) between the piston and the bellows) and to cool fluid (e.g. make-up/drive fluid) from at least one additional component of the system (e.g. simultaneously and/or concurrently performing both operations). In some embodiments, the make-up system 510 may be configured as the sole cooling system for the overall bellows pump system (having the pump and the at least one additional component), while in other embodiments the make-up system 510 may work with one or more external/additional/independent cooler system to jointly cool the overall bellows pump system (for example, allowing for use of a smaller external cooler, while still effectively cooling the system). In embodiments, a control system may be configured to determine and control appropriate circulation of fluid, for example to optimize cooling as well as to maintain synchronous movement of the bellows and the piston.

Figure 7:
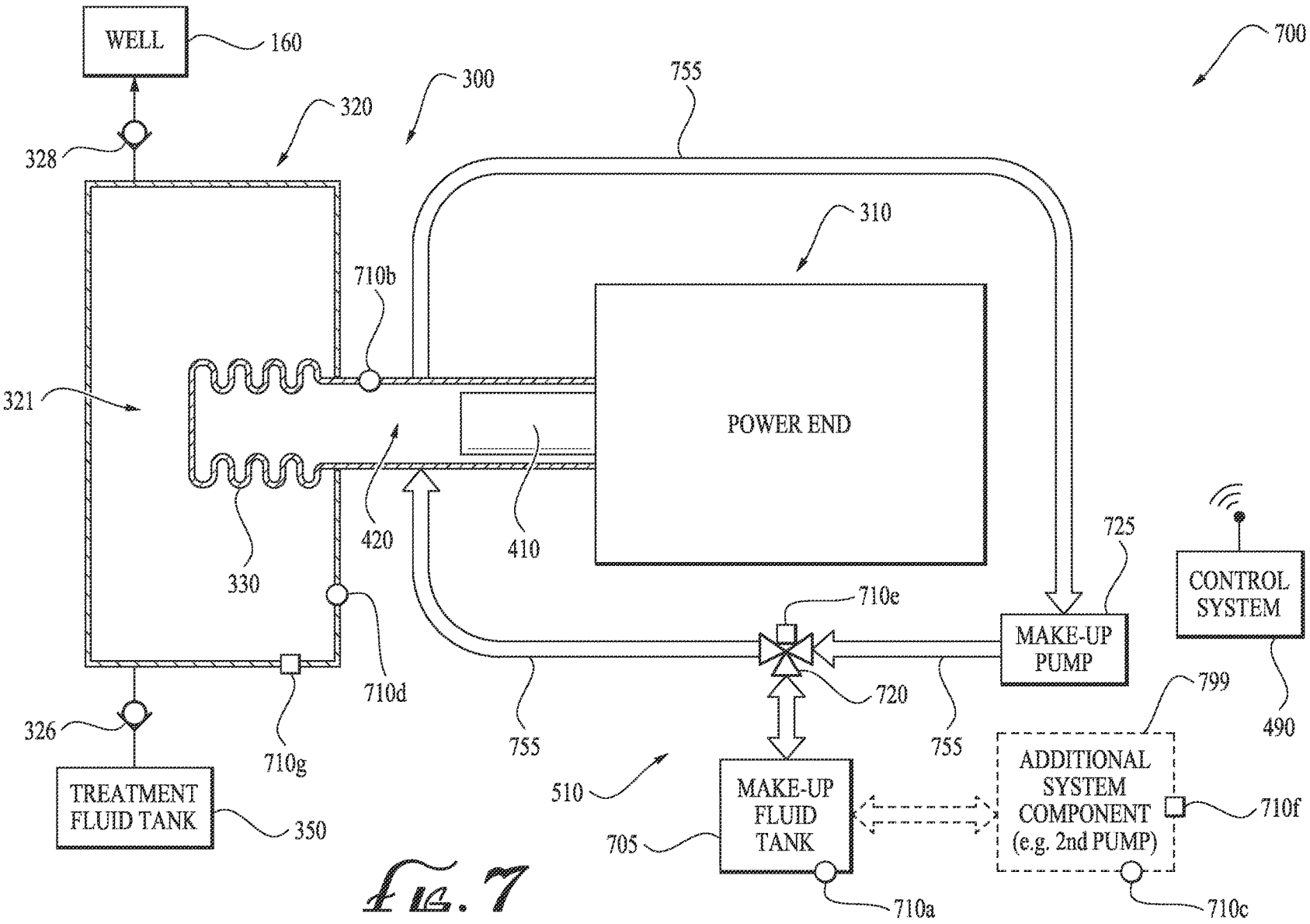
FIG. 7 is a schematic illustration of an exemplary bellows pump system having a make-up system, according to an embodiment of the disclosure.

FIG. 7 schematically illustrates a system 700 having a bellows pump 300, configured to pump treatment fluid into a well 160, and a make-up system 510. As previously discussed, the pump 300 can include a power end 310 having a piston 410 (e.g. disposed in a bore 420 of the power end 310, with the bore 420 in fluid communication with the bellows 330 and the piston 410 configured to reciprocally move fluid with respect to the bellows 330), a fluid end 320 having a chamber 321 (e.g. with a suction valve 326 and a discharge valve 328 in fluid communication therewith), and an expandable bellows 330. The power end 310 can be configured to reciprocally expand and contract the bellows 330 within the chamber 321 based on movement of fluid (e.g. make-up/drive fluid) by the piston 410, thereby pumping treatment fluid through the chamber 321 towards the well 160. As treatment fluid passes through the chamber 321, it may pass across/contact the bellows 330. In many embodiments, the treatment fluid may be cooler than the bellows 330 (e.g. with the treatment fluid having a lower temperature that the fluid in the bellows 330), which may allow for the bellows 330 to vent heat (e.g. via conductive heat exchange) into the treatment fluid.

The make-up system 510 may be configured to maintain a controlled volume of fluid (e.g. make-up/drive fluid) between the piston 410 and the bellows 330 and/or to keep the piston 410 and bellows 330 in sync. In embodiments, the make-up system 510 may include a make-up fluid source 705 (e.g. a tank of make-up/drive fluid) fluidly coupled to the bellows 330 and to at least one additional component 799 of the system 700. In embodiments, the make-up system 510 can be configured to receive heat via circulation of fluid (e.g. make-up/drive fluid) with the at least one additional component 799 of the system 700 (e.g. with the fluid of make-up system 510 being used as coolant for the at least one additional component 799), and to discharge heat via circulation of the fluid with the bellows 330 (e.g. in addition to performing its make-up syncing function). For example, the make-up system 510 can be configured to cool fluid (e.g. make-up/drive fluid) from the at least one additional component 799, in addition to and/or simultaneously with and/or concurrently with maintaining the controlled volume of fluid between the piston 410 and the bellows 330 and/or keeping the bellows 330 and the piston 410 in sync.

Some system 700 embodiments can also comprise a control system 490, for example having one or more sensor 710 configured to detect one or more parameter of the system 700. In embodiments, the control system 490 can be configured to receive data from the one or more sensor 710, to evaluate the sensor data to determine a circulation protocol/plan for circulating fluid between the make-up system 510 and bellows 330 (e.g. between the make-up fluid source 705, the bellows 330, and/or the at least one additional component 799), and responsive to determining a circulation protocol, to circulate fluid between the make-up system 510 and the bellows 330 (e.g. in accordance with/based on the circulation protocol). In some embodiments, the control system 490 can further be configured to evaluate the sensor data to determine whether the bellows 330 and piston 410 are out of sync (e.g. whether the amount of fluid between the piston 410 and the bellows 330 is no longer approximately equal to the controlled volume (e.g. beyond a threshold for the controlled volume of fluid)), and responsive to determining that the bellows 330 and piston 410 are out of sync, to use the make-up system 510 to adjust the amount of fluid between the piston 410 and the bellows 330 to return the piston 410 and bellows 330 to sync (e.g. to return the amount of fluid between the piston 410 and the bellows 330 to the controlled volume), thereby maintaining the controlled volume of fluid between the piston 410 and the bellows 330.

In embodiments, the one or more sensor 710 may be configured to detect one or more of the following parameters at one or more location within the system 700: temperature, flow rate, pressure, viscosity, contamination, strain, and/or position of one or more component of the system 700. For example, in FIG. 7, a first temperature sensor 710*a* may be disposed on and/or configured to measure the temperature of fluid in the make-up fluid source 705, a second temperature sensor 710*b* may be disposed on and/or configured to measure the temperature of fluid in the bellows 330, a third temperature sensor 710*c* may be disposed on and/or configured to measure the temperature of fluid in the at least one additional component 799 of the system 700, and/or a fourth temperature sensor 710*d* may be disposed on and/or configured to measure the temperature of fluid in the chamber 321 (e.g. the treatment fluid). In some embodiments, a first flow rate sensor 710*e* may be disposed on and/or configured to measure the flow of fluid in the make-up system 510 (e.g. flowing into and/or out of the bellows 330 and/or into or out of the make-up fluid source 705 and/or through the make-up pump 725), a second flow rate sensor 710*f* may be disposed on and/or configured to measure the flow of fluid in the at least one additional component of the system 799 (e.g. into, out of, and/or through the at least one additional component 799), and a third flow rate sensor 710*g* may be disposed on and/or configured to measure the flow of fluid in the chamber 321 (e.g. the flow of treatment fluid).

In embodiments, the make-up system 510 can further include at least one make-up valve 720 configured to control fluid flow between the make-up system 510 and the bellows 330 and/or at least one make-up pump 725 configured to pump fluid between the make-up system 510 and the bellows 330. The make-up system 4510 may also include at least one make-up port 515 (see FIG. 5 for example) in fluid communication with the bellows 330 and the make-up fluid source 705. In FIG. 7, the make-up valve 720 can be disposed between the make-up fluid source 705 and the bellows 330, between the make-up fluid source 705 and the make-up pump 725, and/or between the bellows 330 and the make-up pump 725. In some embodiments, the make-up system 510 may further comprise one or more fluid conduit 755 (e.g. piping or tubing) configured to fluidly couple various portions of the system 700. For example, fluid conduit 755 may fluidly couple the make-up fluid source 705 to the make-up valve 720, the make-up valve 720 to the bellows 330, the make-up valve 720 to the make-up pump 725, the bellows 330 to the make-up pump 725, the bellows 330 to the at least one additional component 799, and/or the at least one additional component 799 to the make-up pump 725 or make-up valve 720 or make-up fluid source 705. The control system 490 can be configured to operate the make-up pump 725 and/or make-up valve 720 to control circulation of fluid between the make-up system 510 and the bellows 330 (e.g. by sending instructions to the make-up valve 720 and/or make-up pump 725, which may have actuators responsive to such instructive signals). FIG. 7 illustrates an embodiment in which the control system 490 communicates wirelessly.

By way of example, the at least one additional component 799 of the system 700 may include: one or more additional pump, an intensifier, the power end 310 of the pump 300 (e.g. a head of the piston 410 of the power end 310 of the pump 300—e.g. a first portion of a bore 420 of the power end 310 configured for reciprocal movement of the head of the piston 410), a hydraulic circuit configured to reciprocally move the piston 410 within a bore 420 of the power end 310, hydraulics, lube pumps, cylinders, bellows, pistons/plungers, packing, and combinations thereof. In some embodiments, the at least one additional component 799 may comprise any component of the system 700 which can use the same fluid as the make-up system 510 and/or which may need fluid cooling.

In embodiments, the control system 490 may determine (e.g. via the circulation protocol) an amount of time to hold fluid in the bellows 330, a source of fluid to circulate to the bellows 330 (e.g. from the make-up fluid source 705 and/or the at least one additional component 799), and/or an amount of fluid to circulate to optimize heat transfer/cooling of the fluid. For example, cooling may be optimized based on the amount of time that fluid is held in the bellows 330 and/or the source and amount of fluid circulated. In some embodiments, the amount of fluid to circulate can be approximately equal to the controlled volume of fluid (e.g. being maintained between the piston 410 and the bellows 330). In some embodiments, the control system 490 may use temperature of the bellows 330 and temperature of the make-up fluid source 705 to determine the circulation protocol. Some embodiments may further use temperature of the at least one additional component 799 when determining the circulation protocol. In some embodiments, the control system 490 may use flow rate to determine the circulation protocol (e.g. the flow rate of fluid into and/or out of the bellows, the flow rate of treatment fluid, and/or the flow rate of fluid through the make-up system 510). In some embodiments, the control system 490 may (e.g. additionally) use one or more of the following to determine the circulation protocol: temperature of the treatment fluid/chamber 321, pressure (e.g. in the bellows 330 and/or the chamber 321), viscosity, contamination, and/or position of one or more component of the system 700 (e.g. the position of the piston 410 and/or the bellows 330).

Typically, the bellows 330 (e.g. the fluid in the bellows 330) may have a temperature greater than that of the treatment fluid/chamber 321 (e.g. the bellows 330 is typically hotter than the treatment fluid/chamber 321). Thus, the treatment fluid flowing though the chamber 321 and contacting the bellows 330 can serve as a heat sink, using its relatively cooler temperature (e.g. relative to the bellows 330) to draw heat from the bellows 330 (which may thereby cool the fluid in the bellows 330). It should be understood that hot, cold, hotter, cooler, colder, and other such terms are relative terms and do not denote any specific temperature. Rather, reference to a hot fluid means that the fluid is hotter than a cool fluid of the system and/or has been heated, while reference to a cool fluid means a fluid that is colder than a hot fluid of the system and/or has not been heated or has been heated less than the fluid of another portion of the system (for example another portion of the system with which the fluid is interacting).

In embodiments, circulation of fluid between the make-up system 510 and the bellows 330 may comprise introducing/injecting (e.g. heated/hot) fluid from the make-up fluid source 705 into the bellows 330. In FIG. 7 for example, the make-up fluid source 705 may be heated by its interaction with the at least one additional component 799 of the system 700 (for example, with the fluid of the make-up system 510 being used to cool the at least one additional component 799), and this heated fluid from the make-up fluid source 705 may be circulated to the bellows 330 for cooling (e.g. via conduction with the cooler treatment fluid). In embodiments, the circulation may further comprise introducing/injecting (e.g. cool) fluid from the bellows 330 into the make-up fluid source 705. Such an approach may cool the make-up fluid source 705 by withdrawing hotter fluid and inserting cooler fluid (and may also allow for maintenance of the controlled volume of fluid between the piston 410 and the bellows 330). In some embodiments, circulation of fluid may further comprise introducing/injecting (e.g. cool) fluid from the bellows 330 into the at least one additional component 799, and introducing/injecting fluid from the at least one additional component 799 into the make-up fluid source 705.

Figure 9:
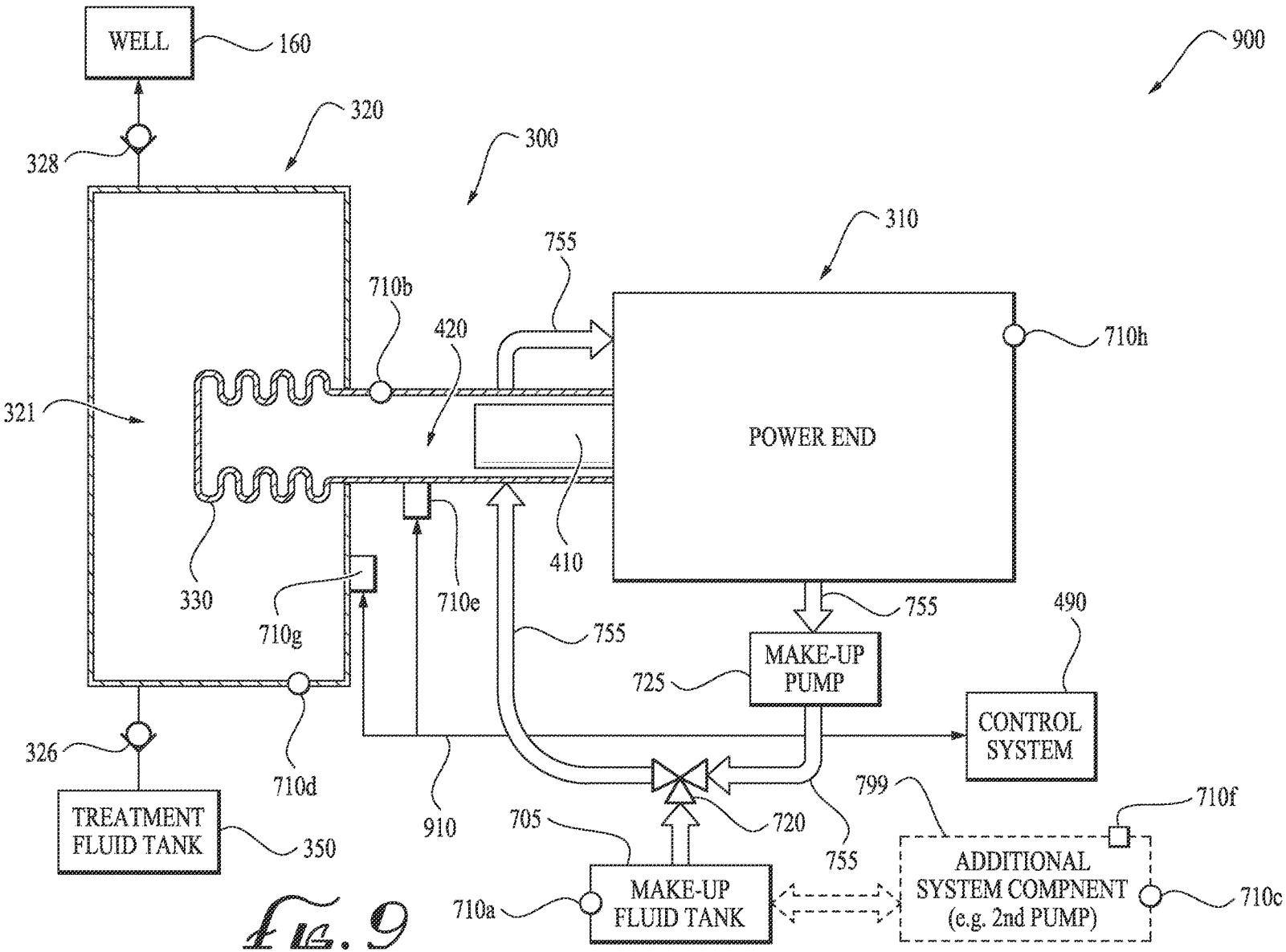
FIG. 9 is a schematic illustration of another exemplary bellows pump system, according to an embodiment of the disclosure.

FIG. 9 schematically illustrates a system 900 similar to the system 700 of FIG. 7, in which the at least one additional component of the system 900 may include the power end 310 of the pump 300 (e.g. the pump 300 having the bellows 330). So, in FIG. 9 the make-up system 510 is fluidly coupled to (e.g. in fluid communication with) the power end 310 of the pump 300. For example, the make-up system 510 may be in fluid communication with the first portion of the bore 420 of the pump 330/intensifier, and the same fluid used in the make-up system 510 (e.g. make-up fluid) may be drive fluid and/or lubricant for the power end 310. In FIG. 9, the make-up fluid source 705 may be fluidly coupled to the make-up valve 720 (e.g. via fluid conduit 755), for example with the make-up valve 720 disposed between the bellows 330 and the make-up fluid source 705. The power end 310 of the pump 399 may be fluidly coupled to the make-up pump 725 (e.g. via fluid conduit 755), which may be fluidly coupled to the make-up valve 720 (e.g. via fluid conduit 755). The bellows 330 may be fluidly coupled (e.g. via fluid conduit 755) with the power end 310 of the pump 300. In some embodiments, the make-up fluid source 705 may additionally be in fluid communication with one or more additional system components 799 (e.g. in addition to the power end 310 of the pump 300), although in the embodiment of FIG. 9 this is merely optional. For example, the make-up fluid source 705 may be fluidly coupled both to the power end 310 of the pump 300 and to at least one additional system component 799 (which for example could be external to pump 300). FIG. 9 illustrates an embodiment in which the control system 490 communicates via wired connection.

In some embodiments, the control system 490 may determine the circulation protocol based on temperature, for example prioritizing flow from whichever of the make-up fluid source 705 or the at least one additional component 799 (e.g. the power end 310 of the pump 300) has hotter fluid to the bellows 330. For example, circulation may comprise introducing/injecting (e.g. heated/hot) fluid from the hotter of the make-up fluid source 705 or the at least one additional component in 799 (e.g. the power end 310 of the pump 300) to the bellows 330 for cooling (e.g. with the hotter of the make-up fluid source 705 or the at least one additional component 799, such as the power end 310, being prioritized for circulation of fluid with the bellows 330). In some embodiments, temperature/heat considerations may be based on absolute temperature (e.g. the measured temperature), while in other embodiments temperature/heat considerations may be based on relative temperature (e.g. the difference between the measured temperature and the corresponding safe operating temperature limit for the portion of the system in question). Both embodiments are included in this disclosure, and any reference to temperature (e.g. hotter, cooler, etc.) can include both absolute and relative considerations (unless for example one is specifically required).

In some embodiments (e.g. in instances when the power end 310 is hotter than the make-up fluid source 705), circulation of fluid between the make-up system 510 and the bellows 330 may comprise injecting (e.g. heated/hot) fluid from the at least one additional component (e.g. the power end 310, as shown in FIG. 9) into the bellows 330, and injecting (e.g. cool) fluid from the bellows 330 into the at least one additional component (e.g. the power end 310 of the pump 300, as shown in FIG. 9). In some embodiments, (e.g. in instances when the make-up fluid source 705 is hotter than the power end 310), circulation of fluid between the make-up system 510 and the bellows 330 may comprise introducing/injecting (e.g. heated/hot) fluid from the make-up fluid source 705 into the bellows 330. In some embodiments, circulation may further comprise introducing/injecting (e.g. cool) fluid from the bellows 330 into the make-up fluid source 705, while in other embodiments, circulation may further comprise introducing/injecting (e.g. cool) fluid from the bellows 330 into the at least one additional component (e.g. the power end 310 of pump 300, as shown in FIG. 9), and introducing/injecting fluid from the at least one additional component (e.g. the power end 310, as shown in FIG. 9) into the make-up fluid source 705.

In embodiments, the control system 490 (e.g. with the circulation protocol) can be configured to hold fluid in the bellows 330 (e.g. for heat exchange with the treatment fluid in the chamber 321 of the fluid end 320, for example via conduction) until the fluid in the bellows 330 is cooler (e.g. has a lower temperature) than the make-up fluid source 705 or the at least one additional component (for example, the power end 310 as shown in FIG. 9), and then to circulate fluid. For example, once the fluid in the bellows 330 cools sufficiently, fluid may be circulated based on the circulation protocol and/or may be circulated to whichever of the make-up fluid source 705 or the at least one additional component (e.g. the power end 310 as shown in FIG. 9) is now hotter than the bellows 330. In some embodiments, the control system 490 may circulate fluid out of the bellows 330 when the fluid in the bellows 330 cools below the temperature of either the make-up fluid source 705 or the at least one additional component (e.g. the power end 310 as shown in FIG. 9), for example circulating to the hotter of the make-up fluid source 705 or the at least one additional component (e.g. the power end 310).

Figure 8:
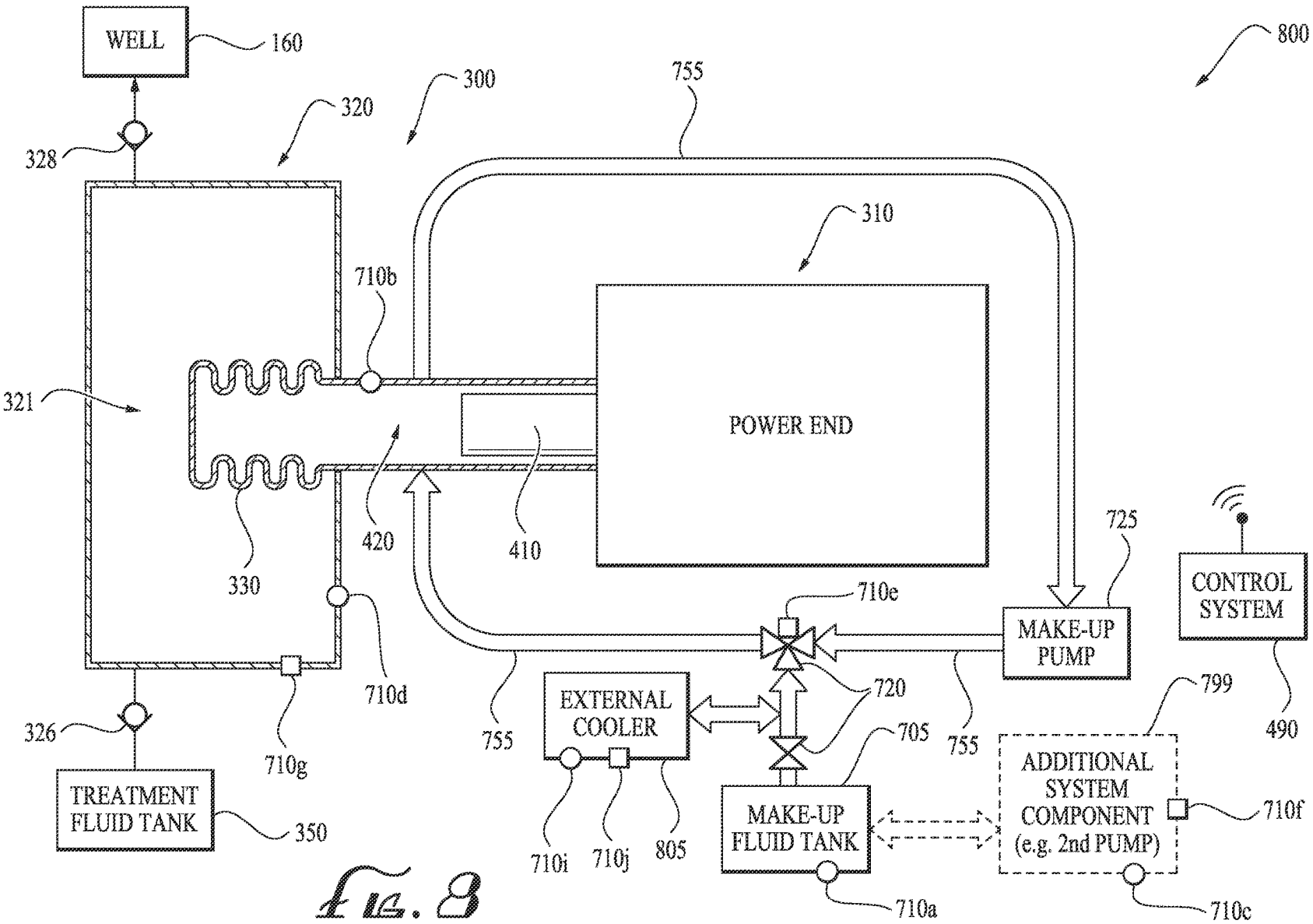
FIG. 8 is a schematic illustration of the exemplary bellows pump system of FIG. 7, further including an external cooler, according to an embodiment of the disclosure.
Figure 10:
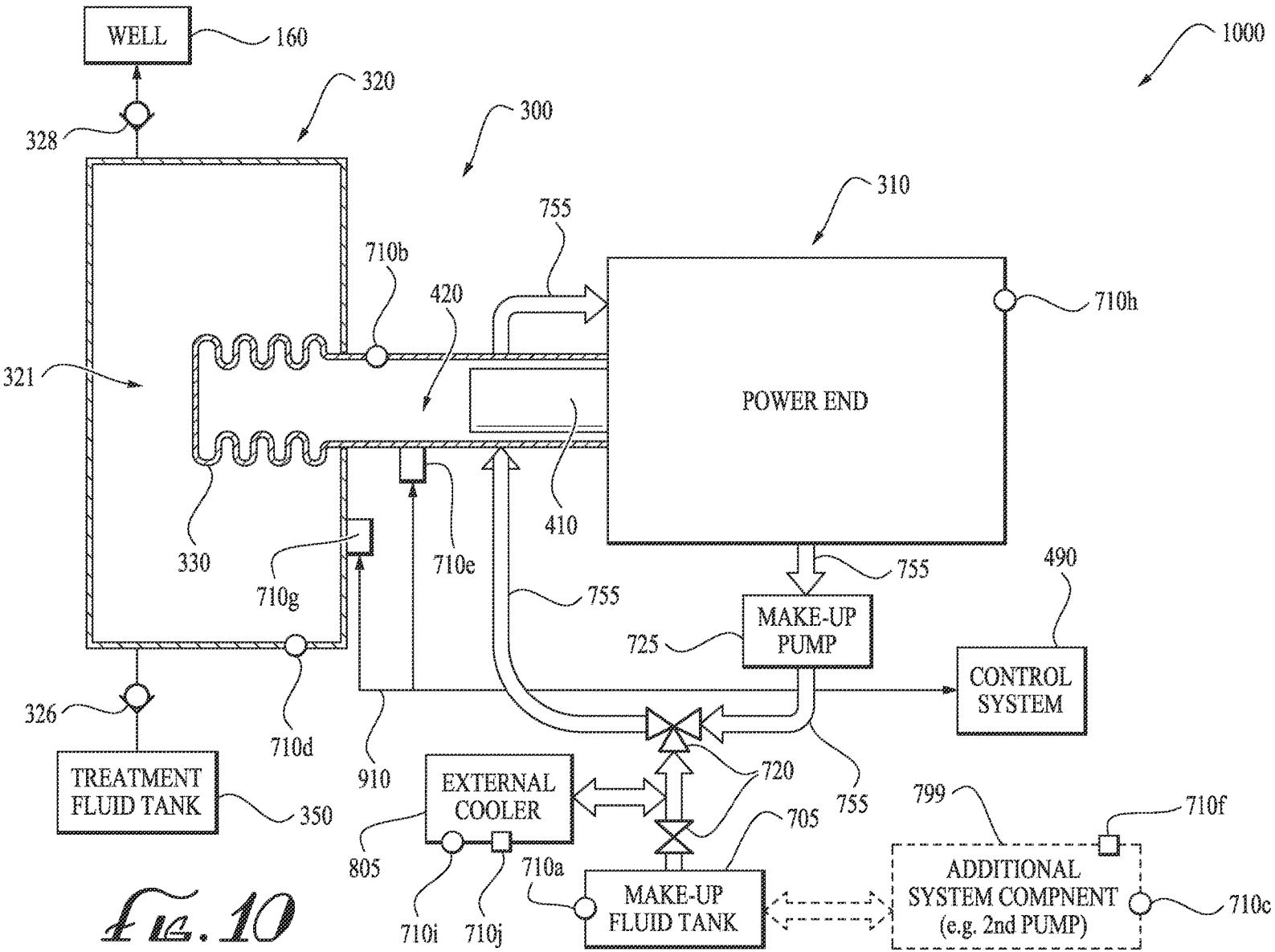
FIG. 10 is a schematic illustration of the exemplary bellows pump system of FIG. 9, further including an external cooler, according to an embodiment of the disclosure.
Figure 11:
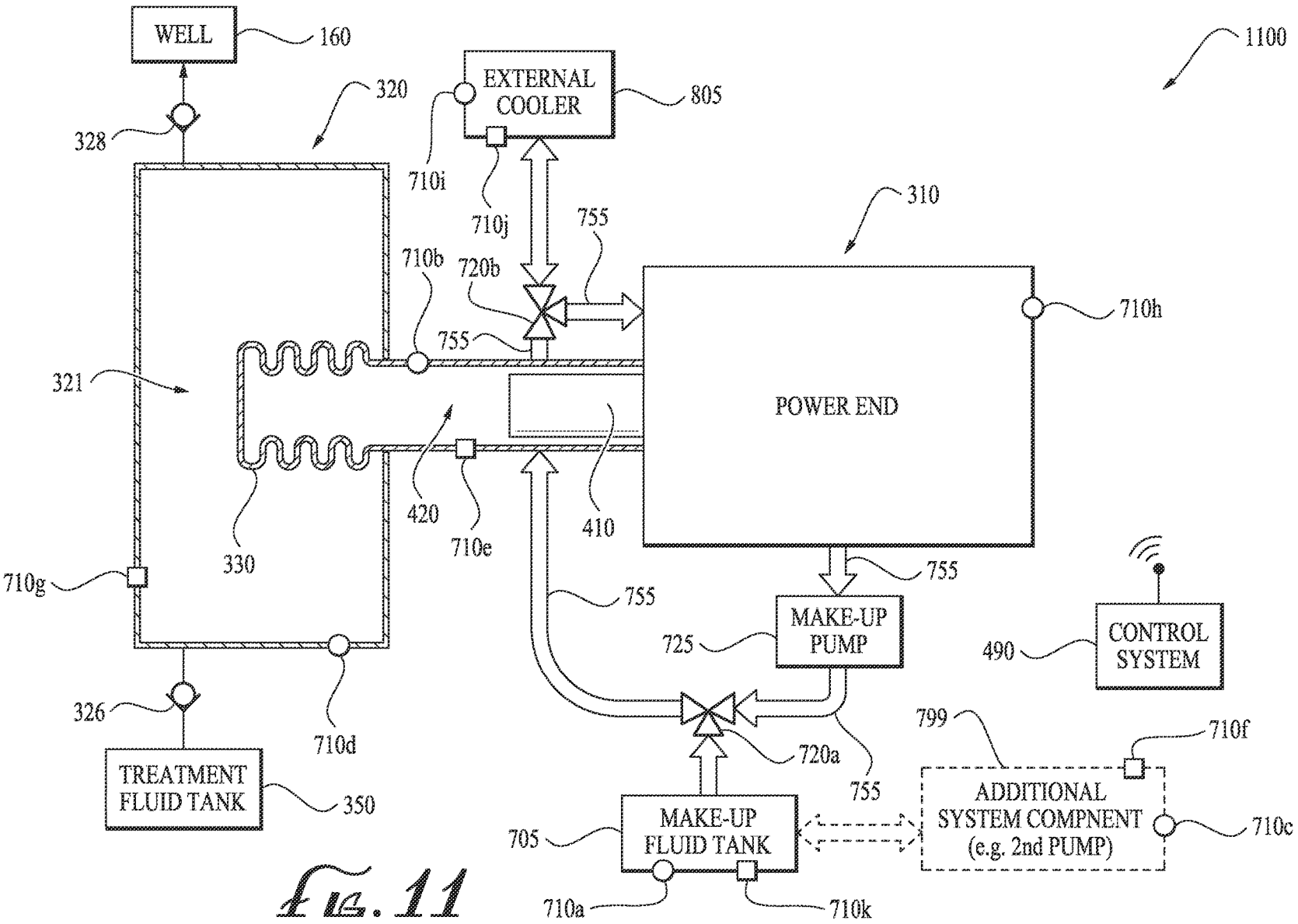
FIG. 11 is a schematic illustration of an exemplary bellows pump, illustrating another potential location for the external cooler, according to an embodiment of the disclosure.

As shown in FIG. 8 (which may be similar to FIG. 7) and FIG. 10 (which may be similar to FIG. 9), some system embodiments may additionally include an external cooler 805. The external cooler 805 can be any mechanism or device configured to cool fluid, for example using conduction, convection, radiant, or other forms of heat transfer. In some embodiments, the external cooler 805 may be used if the system is expected to generate more heat than can be effectively dissipated through the bellows 330 via circulation with the make-up system 510. In some embodiments, the external cooler 805 may be fluidly coupled to the make-up system 510 (e.g. to the make-up fluid source 705 and/or the bellows 330). In FIG. 8, the external cooler 805 may be fluidly coupled to the make-up fluid source 705. For example, two make-up valves 720 may be used, with the first make-up valve **720*a* disposed between the make-up fluid source 705 and the bellows 330, and the second make-up valve 720*b* disposed between the first make-up valve 720*a* and the make-up fluid source 705. The external cooler 805 may be fluidly coupled between the two make-up valves 720, as shown in FIG. 10. The external cooler 805 is not limited to one particular location within the system, but can be fluidly coupled in various locations throughout the system (so long as it has the fluid communication needed to allow cooling operation). For example, FIG. 11 illustrates another location for the external cooler 805, for example fluidly coupled to the bellows 330. For example, the second make-up valve 720*b* may be disposed between the bellows and the at least one additional component (e.g. the power end 310 of the pump 300**).

In embodiments, the external cooler 805 may be sized smaller than otherwise might be needed for the system due to the operation and/or configuration of the make-up system 510 for cooling. In some embodiments, the control system 490 may circulate fluid (e.g. from the bellows 330) to the external cooler 805 only if the bellows 330 cannot handle more heat (e.g. if the bellows 330 temperature is approaching its safe operating temperature limit). For example, when the control system 490 determines that fluid in the bellows 330 is at (e.g. a threshold for) safe operating temperature limit, fluid may be circulated from the bellows 330 to the external cooler 805. And responsive to circulating fluid from the bellows 330 to the external cooler 805, fluid may be circulated from the hotter of the make-up fluid source 705 or the at least one additional component (e.g. the power end 310 as shown in FIG. 10) to the bellows 330. Alternatively, the control system 490 may circulate fluid to the external cooler 805 from the hotter of the make-up fluid system 510 (e.g. the make-up fluid source 705), the at least one additional component (e.g. the power end 310 as shown in FIG. 10), or the bellows 330. For example, the control system 490 may circulate fluid to optimize cooling of fluid in the system using both the bellows 330 and the external cooler 805 (e.g. circulating to either or both at any time). While typically the treatment fluid may be cooler than the bellows 330, in some embodiments and/or at other times, the treatment fluid/chamber 321 may be hotter than the bellows 330. In the event that the treatment fluid/chamber 321 is hotter than the bellows 330, fluid may be circulated from the hottest of the bellows 330, the make-up fluid source 705, or the at least one additional component (e.g. power end 310 as shown in FIG. 10) to the external cooler 805.

In some embodiments, the at least one additional component 799 of the system may include one or more additional pumps. In some embodiments, such multiple pumps may be configured to jointly introduce treatment fluid into the well 160. In some embodiments, the plurality of pumps may be configured to provide constant pumping at approximately constant pressure. For example, one or more pump of the system may be configured so that its power/discharge stroke is out of sync with the power/discharge stroke of one or more other of the pumps of the system. In some embodiments, half of the pumps in the system may be configured to have their power/discharge strokes in sync, for example when the other half of the pumps are having their suction stroke.

Furthermore, while the suction valve 326 and the discharge valve 328 may each be one-way check valves, in alternate embodiments, any other suitable valve may be used as either the suction valve 326 and/or discharge valve 328. Although not required, the bellows pump 300 may be coupled to a pressure intensifier (e.g. having a piston 410 with head 412 larger than rod 414), which may be configured to increase the hydraulic pressure produced by the bellows pump 300. In embodiments, the pressure intensifier may be integrated into the bellows pump 300. It should be understood that various pump embodiments discussed with respect to a piston and/or intensifier may be used without the piston and/or intensifier in other embodiments (e.g. with alternate means or mechanisms for reciprocally expanding and contracting the bellows), all of which are specifically included herein. Additionally, any driver mechanism capable of reciprocally expanding and contracting the bellows may be used, and are included within the scope of this disclosure.

So, in embodiments, the systems and methods described herein may be used in controlling an injection treatment (e.g. of treatment fluid into a well). For example, the injection treatment may be done using intensifier-type pumping systems that utilize one or more bellows 330 for pumping the treatment fluid. The control system 490 of the pump 300 may monitor the pumping systems, determine whether an issue, such as lack of sync and/or heat build-up, occurs, and automatically address the issue(s), for example by using the make-up system 510 to bring the piston 410 and bellows 330 back into sync and/or by circulating fluid to dissipate heat build-up. The present disclosure may provide systems and methods for improved cooling operations, which may use the make-up system 510 to aid in overall system cooling as well as to supplement/adjust the fluid to keep the bellows 330 and the piston 410 properly in sync. The provided systems and methods may be used to monitor bellows 330 position and to determine when to add the fluid (e.g. when there is not adequate amount of fluid in the high-pressure system between the piston 410 and the bellows 330). The provided systems may also use the make-up system 510 for system-wide cooling, for example with the make-up fluid being configured to flow between components of the system to receive heat and move the heat away for dissipation/cooling. In embodiments, the heated fluid may be circulated to the bellows 330 for heat transfer with the treatment fluid (e.g. which is typically cooler).

Returning to FIG. 9, an exemplary cooling infrastructure (e.g. system 900) with a make-up system 510 for the high-pressure system is illustrated. The system 900 of FIG. 9 includes a pump body (e.g. for power end 310), a bellows 330, a piston 410, a plurality of sensors 710, a make-up pump 725, a control system 490, one or more make-up valves 720, and a make-up fluid source (e.g. tank) 705. The pump body (e.g. power end 310) can be associated with a particular pump from an array of pumps. In particular, the pump body/power end 310 can be connected to a reciprocating, intensifier, or linear actuated pump 300 which uses the bellows 330 and the piston 410 in sync to inject treatment fluid into a particular geological formation, such as shale. The system 900 can circulate the make-up fluid from the pump body (e.g. power end 310) to other pump system components via pipelines 755 to cool the pump 300 and other pump system components such as hydraulics, lube pumps, cylinders, bellows 330, pistons 410, packing, etc.

In an embodiment, the system 900 can be configured to include a plurality of sensors 710 coupled to various pump system components, for example via electric lines 910, to detect position of the various pump system components, such as the bellows 330 and the piston 410. The control system 490 can be configured to evaluate measurement data acquired by the plurality of sensors 710. For example, the control system 490 can access input data from the plurality of sensors 710. The input data can include pressure, temperature, bellow position, treatment fluid flow/rate, and other critical parameters from the plurality of sensors 710. As another example, the control system 490 can utilize the one or more make-up valves 720 to regulate the make-up fluid moving through the cooling infrastructure (e.g. the make-up system 510) to optimize heat rejection using treatment fluid and/or to reduce the size of or eliminate the need for external heat exchanges/coolers. The control system 490 can monitor temperature of the make-up fluid and keep a steady or regulated flow of the make-up fluid in the cooling infrastructure. As another example, the control system 490 can transmit a command to the one or more make-up valves 720 to regulate circulation of fluid from the make-up pump 725 or a make-up fluid source 705. In embodiments, the cooling infrastructure (e.g. the control system 490) can be configured to determine the amount of time to keep the make-up fluid in the bellows 330. The amount time to keep the make-up fluid in the bellows 330 can determine how much heat is rejected from the make-up fluid to treatment fluid in the chamber 321.

In an embodiment, the control system 490 can be configured to include a self-learn mode to read the measurement data from the plurality of sensors 710 and adjust the make-up fluid on the fly. In particular, the control system 490 can monitor fluid temperature and flow to regulate the make-up fluid pump 725, the one or more make-up valves 720, and make-up fluid source 705 to improve cooling efficiency of make-up fluid passing through the system 900. For example, the control system 490 can regulate the make-up fluid passing through the bellows 330 that is pumping a treatment fluid in the system 900. The control system 490 can allow the one or more make-up valves 720 to regulate flow through the bellows 330 and keep the make-up fluid in contact with the bellows 330 for an optimal amount of time to reject heat through the bellows 330 into the high-pressure system (e.g. into the treatment fluid in chamber 321).

In an embodiment, the control system 490 can be configured to use a machine learning model to determine the make-up fluid circulation based on the input data, such as pressure, temperature, bellow position, treatment fluid flow/rate, and other critical parameters from the plurality of sensors 710. The machine learning model can be trained using a decision tree based algorithm, such as decision tree, random forest, etc. In an embodiment, the control system 490 can apply the decision tree algorithm to determine a tree-like model to classify one or more subjects into a map of possible outcomes of multiple related choices in which each internal node represents a test on an attribute, each branch represents an outcome of the test, and each leaf node represents a class label. A path from root to leaf is determined based on a decision tree classification rule. In particular, a decision tree typically starts with a single node, which branches into possible outcomes. Each of those outcomes leads to additional nodes, which branch off into other possible outcomes. The accuracy of a decision tree model is controlled by a depth and a node splitting function of the decision tree model at the cost of increasing computation time. A decision tree model may be evaluated using one or more metrics, such as accuracy, sensitivity, specificity, precision, miss rate, false discovery rate, and false omission rate, etc., using the measurements classified by the decision tree model.

In an embodiment, the control system 490 can apply the random forest algorithm to determine a random forest model consisting of multiple decision trees. A decision tree model is a block of a random forest model and multiple decision tree models are combined to make a random forest model. For example, each individual tree in the random forest model splits out a class prediction and the class with the most votes becomes our model's winning prediction. Compared to a decision tree algorithm, a random forest tree uses a large number of relatively uncorrelated decision tree models to operate as a committee to determine a winner class which usually outperforms any of individual constituent decision tree models.

In an embodiment, the control system 490 can be configured to include a heuristic mode to read the measurement data from the plurality of sensors 710 and adjust the make-up fluid based on predetermined set points or maps of parameters such as temperature, flow, bellows position, treatment fluid rate, and other critical parameters. The predetermined set points or maps can be determined from prior experience or user input, for example.

In an embodiment, the cooling infrastructure (e.g. the make-up system 510 configured for cooling) can be used on other fluid systems capable of passing fluid through the bellows 330. These fluid systems can include fluid used to cool the pump 300, engine, motor, variable frequency drives or even fluid used for lubrication. The cooling infrastructure can also be configured to direct fluid to external coolers 805, besides the bellows 330 which are positioned in the fluid stream.

FIG. 10 illustrates an example system 1000 with a make-up system 510 and an external cooler 805 for the high-pressure system. The control system 490 can be configured to regulate the make-up fluid passing through an external cooler 805. The control system 490 can allow the make-up system 510 to regulate the make-up flow through the external cooler 805 for an optimal amount of time to reject heat from the high pressure system.

In various embodiments, the inputs to the control system 490 via the wired or wireless communications include sensor data from one or more sensors 710 positioned in the system that represent respective pressure, temperature, flow/rate, viscosity, contamination/particle count, and/or bellows position. In some embodiments, the outputs of the control system 490 via one or more wired or wireless communications include data that controls the make-up valve(s) 725 and/or the make-up pump(s) 720 (e.g. to control make-up fluid regarding synchronizing the bellows 330 and piston 410 and/or to control circulation of fluid to cool the system).

Disclosed embodiments also comprise exemplary methods for cooling a bellows pump during introduction of treatment fluid into a well. Such methods may use any of the disclosed pump or system embodiments, such as the examples illustrated in FIGS. 7-11. For example, an exemplary method embodiment may comprise: pumping treatment fluid into the well using the bellows pump system (e.g. wherein the bellows pump system comprises a pump having a bellows and a piston, and a make-up system configured to maintain a controlled volume of drive fluid between the piston and the bellows and/or to keep the piston and bellows in sync, with the make-up system fluidly coupled to the bellows and to at least one additional component of the system), and cooling fluid (e.g. make-up/drive fluid from the at least one additional component) using the make-up system. In embodiments, cooling fluid (e.g. from the at least one additional component) may comprise circulating fluid between the make-up system and the bellows. Some embodiments may further comprise determining that the bellows and piston are out of sync, and using the make-up system to adjust the amount of fluid (e.g. injecting or removing make-up/drive fluid) between the piston and the bellows to return the piston and bellows to sync. In some embodiments, the system may further comprise a control system. In embodiments, responsive to receiving (e.g. at the control system) sensor data from one or more sensor configured to detect one or more parameter of the bellows pump system, the method may further include determining a circulation protocol (e.g. based on the sensor data), and responsive to determining a circulation protocol, circulating fluid between the make-up system and the bellows (e.g. based on the circulation protocol).

In some embodiments, circulating fluid may comprise operating (e.g. by the control system sending instructions) a make-up pump and/or a make-up valve to control fluid flow. In some embodiments, pumping treatment fluid into the well may comprise pumping treatment fluid through a chamber of a fluid end of the pump into the well, wherein the treatment fluid contacts the bellows in the chamber (e.g. allowing for conduction heat transfer therebetween). Some embodiments may further comprise receiving/absorbing heat from the at least one additional component into the make-up fluid system (e.g. into the fluid of the make-up fluid system), and circulating fluid may comprise circulating heated fluid into the bellows and/or shedding/dissipating heat from the fluid in the bellows into the treatment fluid (e.g. via conduction).

In some embodiments, determining a circulation protocol may comprise determining an amount of time to hold fluid in the bellows, a source of fluid to circulate to the bellows, and/or an amount of fluid to circulate to optimize heat transfer/cooling of the fluid (e.g. wherein cooling is optimized based on the amount of time that fluid is held in the bellows and/or the source and amount of fluid circulated). In embodiments, the amount of fluid to circulate may be approximately equal to the controlled volume of fluid (e.g. being maintained between the piston and the bellows). In some embodiments, the control system may use temperature of the bellows and temperature of the make-up fluid source to determine the circulation protocol. In some embodiments, the control system may further use the temperature of the at least one additional component to determine the circulation protocol. In some embodiments, the control system may use flow rate to determine the circulation protocol. In some embodiments, the control system may use one or more of the following to determine the circulation protocol: temperature of the chamber/treatment fluid, pressure, viscosity, contamination, and/or position of one or more component of the system. In some embodiments, the control system may determine the circulation protocol based on temperature, for example with the circulation protocol prioritizing flow from whichever of the make-up fluid source or the at least one additional component (e.g. the power end of the pump) has hotter fluid to the bellows.

In some embodiments, the make-up source may be heated by the at least one additional component of the system, and circulating fluid may comprise circulating the heated fluid from the make-up fluid source into the bellows. In some embodiments, circulating heated fluid into the bellows further comprises circulating (e.g. cool) fluid from the bellows into the make-up fluid source. Some embodiments may further comprise holding the circulated fluid in the bellows until the fluid cools to a temperature below that of the make-up fluid source. In some embodiments, circulating fluid into the bellows may further comprise circulating fluid from the bellows into the at least one additional component.

In some method embodiments, the at least one additional component may include a power end of the pump fluidly coupled to the make-up system (e.g. to the make-up fluid source). In some embodiments, determining a circulation protocol may further comprise determining which of the power end and the make-up fluid source contains hotter fluid, and circulating the hotter fluid (e.g. the fluid from the hotter source) to the bellows. For example, determining a circulation protocol may further comprise determining which of the power end and the make-up fluid source contains hotter fluid, and responsive to determining that the power end fluid is hotter, circulating the (e.g. hotter) power end fluid to the bellows. In some embodiments, the method may further comprise circulating the (e.g. cool) fluid from the bellows to the power end. In another example, determining a circulation protocol may further comprise determining which of the power end and the make-up fluid source contains hotter fluid, and responsive to determining that the make-up fluid source is hotter, circulating the (e.g. hotter) fluid from the make-up fluid source to the bellows. In some embodiments, the method may further comprise circulating the power end fluid to the make-up fluid source and the (e.g. cool) bellows fluid to the power end. In other embodiments, the method may further comprise circulating the bellows fluid to the make-up fluid source.

Once heated fluid is circulated to the bellows, it may be held in the bellows for heat transfer (e.g. with the treatment fluid in the chamber of the fluid end of the pump). In some embodiments, the control system may determine how long to hold the heated fluid in the bellows, for example to optimize heat transfer (e.g. and further circulation may not occur until the circulation protocol specifies). Some embodiments further comprise holding fluid in the bellows until the fluid is cooler than either the fluid in the make-up fluid source or the fluid in the power end. In embodiments, the fluid may then be circulated from the hotter of the make-up fluid source or the power end into the bellows.

Some method embodiments may further comprise circulating fluid with an external cooler. In some embodiments, circulating fluid with an external cooler may comprise only circulating to the external cooler in the event that the bellows cannot handle more heat (e.g. the bellows is near its safe operating temperature limit or the temperature of the bellows is at or above the temperature of the treatment fluid in the chamber). So in some examples, the bellows may be exclusively used for cooling of the system as long as the bellows can handle it, and only when the bellows cannot handle the heat of the system, then using the external cooler. In other embodiments, circulating fluid with an external cooler may comprise cooling the fluid (e.g. of the make-up system) using both the bellows and the external cooler (e.g. simultaneously and/or working together), for example with circulation configured to optimize heat dissipation for the system.

One or more of the system embodiments disclosed herein (e.g. relating to FIGS. 7-11) may be used to implement any of the disclosed method embodiments and/or may be involved in any of the disclosed method embodiments. For example, a programmable storage device can have program instructions stored thereon configured to cause a processor (e.g. of the control system of the bellows pump system) to perform any of the disclosed method embodiments, and/or a non-transitory computer-readable medium can have program instructions stored thereon configured to cause a control system (e.g. of the bellows pump system) to perform any of the disclosed method embodiments. Such instructions may be used by the control system of the disclosed bellows pump system embodiments, for example to operate the bellows pump system.

Additional Disclosure

The following are non-limiting, specific embodiments in accordance with the present disclosure:

In a first embodiment, a system for pumping treatment fluid into a well comprises: a bellows pump configured to pump treatment fluid into the well, comprising: a power end comprising a piston; a fluid end having a chamber; and an expandable bellows, wherein the power end is configured to reciprocally expand and contract the bellows within the chamber based on movement of fluid (e.g. make-up/drive fluid) by the piston; and a make-up system configured to maintain a controlled volume of fluid (e.g. make-up/drive fluid) between the piston and the bellows and/or to keep the piston and bellows in sync; wherein: the make-up system comprises a make-up fluid source (e.g. a tank of make-up/ drive fluid) fluidly coupled to the bellows and to at least one additional component of the system; the make-up system is configured to receive heat via circulation of fluid (e.g. make-up/drive fluid) with the at least one additional component of the system (e.g. with the fluid of make-up system used as coolant for the at least one additional component), and to discharge heat via circulation of the fluid with the bellows (e.g. with the make-up system being configured to cool fluid (e.g. make-up/drive fluid) from the at least one additional component, in addition to (and/or simultaneously and/or concurrently with) maintaining the controlled volume of fluid between the piston and the bellows and/or keeping the bellows and the piston in sync).

A second embodiment can include the system of the first embodiment, further comprising a control system having one or more sensor configured to detect one or more parameter of the system; wherein the control system is configured to receive data from the one or more sensor, to evaluate the sensor data to determine a circulation protocol/plan for circulating fluid between the make-up system and bellows (e.g. between the make-up fluid source, the bellows, and the at least one additional component), and responsive to determining a circulation protocol, to circulate fluid between the make-up system and the bellows (e.g. in accordance with/based on the circulation protocol).

A third embodiment can include the system of the second embodiment, wherein the control system is further configured to evaluate the sensor data to determine whether the bellows and piston are out of sync (e.g. whether the amount of fluid between the piston and the bellows is no longer equal to the controlled volume +/− (e.g. beyond a threshold)), and responsive to determining that the bellows and piston are out of sync, to use the make-up system to adjust the amount of fluid between the piston and the bellows to return the piston and bellows to sync (e.g. to return the amount of fluid between the piston and the bellows to the controlled volume), thereby maintaining the controlled volume of fluid between the piston and the bellows.

A fourth embodiment can include the system of the second or third embodiment, wherein the one or more sensor is configured to detect one or more of the following parameters at one or more location within the system: temperature, flow rate, pressure, viscosity, contamination, and/or position of one or more component of the system.

A fifth embodiment can include the system of any one of the second to fourth embodiments, wherein the make-up system further comprises at least one make-up valve configured to control fluid flow between the make-up system and the bellows and at least one make-up pump configured to pump fluid between the make-up system and the bellows.

A sixth embodiment can include the system of the fifth embodiment, wherein the make-up valve is disposed between make-up fluid source and/or bellows or between the power end and bellows.

A seventh embodiment can include the system of the sixth embodiment, wherein the make-up system further comprises at least one make-up port in fluid communication with the bellows and the make-up fluid source.

An eighth embodiment can include the system of any one of the fifth to seventh embodiments, wherein responsive to determining a circulation protocol, the control system operates the make-up pump and/or make-up valve to circulate fluid between the make-up system and the bellows (e.g. by sending instructions to the make-up valve and/or make-up pump) (e.g. wherein the circulation is controlled (by the control system) using (e.g. by operation of) the make-up valve and/or the make-up pump).

A ninth embodiment can include the system of any one of the first to eighth embodiments, wherein the at least one additional component of the system comprises: one or more additional pump, an intensifier, a power end of the pump (e.g. a head of the piston of the power end of the pump—e.g. a first portion of a bore of the power end configured for reciprocal movement of the head of the piston), a hydraulic circuit configured to reciprocally move the piston within a bore of the power end, hydraulics, lube pumps, cylinders, bellows, pistons/plungers, packing, and combinations thereof.

A tenth embodiment can include the system of any one of the second to ninth embodiments, wherein the control system determines (e.g. via the circulation protocol) an amount of time to hold fluid in the bellows, a source of fluid to circulate to the bellows, and/or an amount of fluid to circulate to optimize heat transfer/cooling of the fluid (e.g. wherein cooling is optimized based on the amount of time that fluid is held in the bellows and/or the source and amount of fluid circulated).

An eleventh embodiment can include the system of the tenth embodiment, wherein amount of fluid to circulate is approximately equal to the controlled volume of fluid (e.g. being maintained between the piston and the bellows).

A twelfth embodiment can include the system of any one of the second to eleventh embodiments, wherein the control system uses temperature of the bellows and temperature of the make-up fluid source to determine the circulation protocol.

A thirteenth embodiment can include the system of the twelfth embodiment, wherein the control system further uses the temperature of the at least one additional component to determine the circulation protocol.

A fourteenth embodiment can include the system of any one of the second to thirteenth embodiments, wherein the control system uses flow rate to determine the circulation protocol.

A fifteenth embodiment can include the system of any one of the second to fourteenth embodiments, wherein the control system uses one or more of the following to determine the circulation protocol: temperature of the chamber/treatment fluid, pressure, viscosity, contamination, and/or position of one or more component of the system.

A sixteenth embodiment can include the system of any one of the second to fifteenth embodiments, wherein the bellows (e.g. the fluid in the bellows) has a temperature greater than that of the treatment fluid/chamber (e.g. the bellows is hotter than the chamber/treatment fluid).

A seventeenth embodiment can include the system of any one of the first to sixteenth embodiments, wherein circulation of fluid between the make-up system and the bellows comprises introducing/injecting (e.g. heated/hot) fluid from the make-up fluid source into the bellows.

An eighteenth embodiment can include the system of the seventeenth embodiment, wherein circulation further comprises introducing/injecting (e.g. cool) fluid from the bellows into the make-up fluid source.

A nineteenth embodiment can include the system of the seventeenth embodiment, wherein circulation further comprises introducing/injecting (e.g. cool) fluid from the bellows into the at least one additional component, and introducing/injecting fluid from the at least one additional component into the make-up fluid source.

A twentieth embodiment can include the system of any one of the second to sixteenth embodiments, wherein the control system determines the circulation protocol based on temperature (e.g. prioritizing flow from whichever of the make-up fluid source or the at least one additional component has hotter fluid to the bellows).

A twenty-first embodiment can include the system of any one of the second to sixteenth or twentieth embodiments, wherein circulation comprises introducing/injecting (e.g. heated/hot) fluid from the hotter of the make-up fluid source or at least one additional component (e.g. whichever is hotter/has a higher temperature).

A twenty-second embodiment can include the system of any one of the second to sixteenth or twentieth embodiments, wherein circulation comprises introducing/injecting (e.g. heated/hot) fluid from whichever of the make-up fluid source or the at least one additional component is relatively hotter compared to its safe operating temperature limit.

A twenty-third embodiment can include the system of any one of the second to sixteenth or twentieth to twenty-second embodiments, wherein whichever is hotter is determined based on relative heat/temperature compared to a corresponding safe operating temperature limit).

A twenty-fourth embodiment can include the system of any one of the second to twenty-third embodiments, wherein circulation of fluid between the make-up system and the bellows further comprises injecting (e.g. heated/hot) fluid from the additional component into the bellows, and injecting (e.g. cool) fluid from the bellows into the additional component.

A twenty-fifth embodiment can include the system of any one of the second to twenty-fourth embodiments, wherein the control system (e.g. the circulation protocol) is configured to hold fluid in the bellows (e.g. for heat exchange with the treatment fluid in the chamber of the fluid end, for example via conduction) until the fluid in the bellows is cooler (e.g. has a lower temperature) than the make-up fluid source or at least one additional component, and then to circulate fluid (e.g. based on the circulation protocol and/or to whichever of the make-up fluid source or the at least one additional component is now hotter than the bellows).

A twenty-sixth embodiment can include the system of any one of the second to twenty-fifth embodiments, wherein the control system circulates fluid out of the bellows when the fluid in the bellows cools below the temperature of either the make-up fluid source or the at least one additional component (for example circulating to the hotter of the make-up fluid source or the at least one additional component).

A twenty-seventh embodiment can include the system of any one of the first to twenty-sixth embodiments, further comprising an external cooler fluidly coupled to the make-up system (e.g. and bellows).

A twenty-eighth embodiment can include the system of the twenty-seventh embodiment, wherein the external cooler is sized smaller than otherwise might be needed for the system due to the operation and/or configuration of the make-up system for cooling.

A twenty-ninth embodiment can include the system of the twenty-seventh or twenty-eighth embodiment, further comprising a second make-up valve configured to allow diversion of fluid to and from the external cooler (e.g. for circulation with the external cooler).

A thirtieth embodiment can include the system of any one of the twenty-seventh to twenty-ninth embodiments, wherein circulating fluid (e.g. from the bellows) to the external cooler only occurs if the bellows cannot handle more heat (e.g. if the bellows temperature is approaching its safe operating temperature limit), A thirty-first embodiment can include the system of any one of the twenty-seventh to thirtieth embodiments, wherein when the control system determines that fluid in the bellows is at (e.g. a threshold for) safe operating temperature limit, and circulates fluid from the bellows to the external cooler.

A thirty-second embodiment can include the system of any one of the thirtieth to thirty-first embodiments, wherein responsive to circulating fluid from the bellows to the external cooler, circulating fluid from the hotter of the make-up fluid source or the at least one additional component to the bellows.

A thirty-third embodiment can include the system of any one of the twenty-seventh to twenty-ninth embodiments, further comprising circulating fluid to the external cooler from the hotter of the make-up fluid system, at least one additional component, or the bellows A thirty-fourth embodiment can include the system of any one of the twenty-seventh to twenty-ninth or thirty-third embodiments, wherein the control system circulates fluid to optimize cooling of fluid in the system using both the bellows and the external cooler (e.g. always circulating fluid to optimize cooling of fluid in the system using both the bellows and the external cooler).

A thirty-fifth embodiment can include the system of any one of the twenty-seventh to thirty-fourth embodiments, wherein the treatment fluid/chamber is hotter than the bellows, comprising circulating fluid from the hottest of the bellows, the make-up fluid source, or the at least one additional component to the external cooler.

A thirty-sixth embodiment can include the system of any one of the second to thirty-fifth embodiments, further comprising receiving updated sensor data, and updating (e.g. by the control system) the circulation protocol based on updated sensor data.

In a thirty-seventh embodiment, a method for cooling a bellows pump system during introduction of treatment fluid into a well comprises: pumping treatment fluid into the well using the bellows pump system, wherein the bellows pump system comprises a pump having a bellows and a piston, and a make-up system configured to maintain a controlled volume of drive fluid between the piston and the bellows and/or to keep the piston and bellows in sync, and wherein the make-up system is fluidly coupled to the bellows and to at least one additional component of the system; and cooling fluid (e.g. make-up/drive fluid) from the at least one additional component, using the make-up system.

A thirty-eighth embodiment can include the method of the thirty-seventh embodiment, wherein cooling fluid from the at least one additional component comprises circulating fluid between the make-up system and the bellows.

A thirty-ninth embodiment can include the method of any one of the thirty-seventh to thirty-eighth embodiments, further comprising determining that the bellows and piston are out of sync; and using the make-up system to adjust the amount of fluid (e.g. injecting or removing make-up/drive fluid) between the piston and the bellows to return the piston and bellows to sync.

A fortieth embodiment can include the method of any one of the thirty-seventh to thirty-ninth embodiments, wherein the system further comprises a control system, and wherein: responsive to receiving, at the control system, sensor data from one or more sensor configured to detect one or more parameter of the bellows pump system, determining a circulation protocol (e.g. based on the sensor data); and responsive to determining a circulation protocol, circulating fluid between the make-up system and the bellows (e.g. based on the circulation protocol).

In a forty-first embodiment, a method for cooling a bellows pump system during introduction of treatment fluid into a well, comprising: pumping treatment fluid into the well using the bellows pump system, wherein the bellows pump system comprises a pump having a bellows and a piston, a control system, and a make-up system configured to maintain a controlled volume of drive fluid between the piston and the bellows and/or to keep the piston and bellows in sync, and wherein the make-up system is fluidly coupled to the bellows and to at least one additional component of the system; and responsive to receiving, at the control system, sensor data from one or more sensor configured to detect one or more parameter of the bellows pump system, determining a circulation protocol (e.g. based on the sensor data); and responsive to determining a circulation protocol, circulating fluid between the make-up system and the bellows.

A forty-second embodiment can include the method of the forty-first embodiment, further comprising evaluating (e.g. using the control system) the sensor data to determine whether the bellows and piston are out of sync, and responsive to determining that the bellows and piston are out of sync, using the make-up system to adjust the amount of fluid (e.g. injecting or removing make-up/drive fluid) between the piston and the bellows to return the piston and bellows to sync.

A forty-third embodiment can include the method of any one of the forty-first to forty-second embodiments, wherein circulating fluid comprises operating (e.g. by the control system sending instructions) a make-up pump and/or a make-up valve to control fluid flow.

A forty-fourth embodiment can include the method of any one of the forty-first to forty-third embodiments, wherein pumping treatment fluid into the well comprises pumping treatment fluid through a chamber of a fluid end of the pump into the well, wherein the treatment fluid contacts the bellows in the chamber.

A forty-fifth embodiment can include the method of any one of the forty-first to forty-fourth embodiments, further comprising receiving/absorbing heat from the at least one additional component into the make-up fluid system (e.g. into the fluid of the make-up fluid system); wherein circulating fluid comprises circulating heated fluid into the bellows; and shedding/dissipating heat from the fluid in the bellows into the treatment fluid (e.g. via conduction).

A forty-sixth embodiment can include the method of any one of the forty-first to forty-fifth embodiments, wherein determining a circulation protocol comprises determining an amount of time to hold fluid in the bellows, a source of fluid to circulate to the bellows, and/or an amount of fluid to circulate to optimize heat transfer/cooling of the fluid (e.g. wherein cooling is optimized based on the amount of time that fluid is held in the bellows and/or the source and amount of fluid circulated).

A forty-seventh embodiment can include the method of forty-sixth embodiment, wherein the amount of fluid to circulate is approximately equal to the controlled volume of fluid (e.g. being maintained between the piston and the bellows).

A forty-eighth embodiment can include the method of any one of the forty-first to forty-seventh embodiments, wherein the control system uses temperature of the bellows and temperature of the make-up fluid source to determine the circulation protocol.

A forty-ninth embodiment can include the method of the forty-eighth embodiment, wherein the control system further uses the temperature of the at least one additional component to determine the circulation protocol.

A fiftieth embodiment can include the method of any one of the forty-first to forty-ninth embodiments, wherein the control system uses flow rate to determine the circulation protocol.

A fifty-first embodiment can include the method of any one of the forty-first to fiftieth embodiments, wherein the control system uses one or more of the following to determine the circulation protocol: temperature of the chamber/treatment fluid, pressure, viscosity, contamination, and/or position of one or more component of the system.

A fifty-second embodiment can include the method of any one of the forty-first to fifty-first embodiments, wherein the control system determines the circulation protocol based on temperature.

A fifty-third embodiment can include the method of any one of the forty-first to fifty-second embodiments, wherein the circulation protocol prioritizes flow from whichever of the make-up fluid source or the at least one additional component has hotter fluid to the bellows.

A fifty-fourth embodiment can include the method of any one of the forty-first to fifty-third embodiments, wherein the make-up system comprises a make-up fluid source (e.g. a tank of fluid).

A fifty-fifth embodiment can include the method of any one of the forty-first to fifty-fourth embodiments, wherein circulating heated fluid into the bellows further comprises circulating (e.g. cool) fluid from the bellows into the make-up fluid source.

A fifty-sixth embodiment can include the method of any one of the forty-first to fifty-fifth embodiments, further comprising holding the circulated fluid in the bellows until the fluid cools to a temperature below that of the make-up fluid source.

A fifty-seventh embodiment can include the method of any one of the forty-first to fifty-sixth embodiments, further comprising sensing one or more parameter of the system and transmitting the sensor data to the control system.

A fifty-eighth embodiment can include the method of the fifty-seventh embodiment, wherein the one or more sensed parameter comprises: temperature of make-up fluid source and temperature of bellows.

A fifty-ninth embodiment can include the method of any one of the fifty-seventh to fifty-eighth embodiments, wherein the one or more sensed parameter comprises: temperature of chamber/treatment fluid.

A sixtieth embodiment can include the method of any one of the fifty-seventh to fifty-ninth embodiments, wherein the one or more sensed parameter comprises: fluid flow rate (e.g. into and/or out of the bellows/tank).

A sixty-first embodiment can include the method of any one of the fifty-seventh to fifty-ninth embodiments, wherein the one or more sensed parameter comprises temperature of the at least one additional component.

A sixty-second embodiment can include the method of any one of the forty-first to sixty-first embodiments, wherein circulating fluid into the bellows further comprises circulating fluid from the bellows into the at least one additional component.

A sixty-third embodiment can include the method of any one of the forty-first to sixty-second embodiments, wherein the additional component comprises a power end of the pump fluidly coupled to the make-up system (e.g. to the make-up fluid source).

A sixty-fourth embodiment can include the method of the sixty-third embodiment, wherein determining a circulation protocol further comprises determining which of the power end and the make-up fluid source contains hotter fluid, and circulating the hotter fluid (e.g. the fluid from the hotter source) to the bellows.

A sixty-fifth embodiment can include the method of any one of the sixty-third to sixty-fourth embodiments, wherein determining a circulation protocol further comprises determining which of the power end and the make-up fluid source contains hotter fluid, and responsive to determining that the power end fluid is hotter, circulating the power end fluid to the bellows.

A sixty-sixth embodiment can include the method of the sixty-fifth embodiment, further comprising circulating the (e.g. cool) fluid from the bellows to the power end.

A sixty-seventh embodiment can include the method of any one of the sixty-third to sixty-fourth embodiments, wherein determining a circulation protocol further comprises determining which of the power end and the make-up fluid source contains hotter fluid, and responsive to determining that the make-up fluid source fluid is hotter, circulating the make-up fluid source fluid to the bellows.

A sixty-eighth embodiment can include the method of the sixty-seventh embodiment, further comprising circulating the power end fluid to the make-up fluid source and the (e.g. cool) bellows fluid to the power end.

A sixty-ninth embodiment can include the method of the sixty-seventh embodiment, further comprising circulating the bellows fluid to the make-up fluid source.

A seventieth embodiment can include the method of any one of the sixty-third to sixty-ninth embodiments, further comprising holding fluid in the bellows until the fluid is cooler than either the fluid in the make-up fluid source or the fluid in the power end.

A seventy-first embodiment can include the method of the seventieth embodiment, further comprising, responsive to the fluid in the bellows cooling below the temperature of either the make-up fluid source or the power end, circulating fluid from the hotter of the make-up fluid source or the power end into the bellows.

A seventy-second embodiment can include the method of any one of the forty-first to seventy-first embodiments, further comprising circulating fluid with an external cooler.

A seventy-third embodiment can include the method of the seventy-second embodiment, wherein circulating fluid with an external cooler comprises only circulating to the external cooler in the event that the bellows cannot handle more heat (e.g. the bellows is near its safe operating temperature limit or the temperature of the bellows is at or above the temperature of the treatment fluid in the chamber)

A seventy-fourth embodiment can include the method of any one of the seventy-second to seventy-third embodiments, further comprising using the bellows exclusively for cooling of the system as long as the bellows can handle the heat of the system, and only when the bellows cannot handle the heat of the system, using the external cooling system.

A seventy-fifth embodiment can include the method of the seventy-second embodiment, wherein circulating fluid with an external cooler comprises cooling the fluid (e.g. of the make-up system) using both the bellows and the external cooler (e.g. simultaneously and/or in concert), with circulation configured to optimize heat dissipation.

A seventy-sixth embodiment can include the method of any one of the forty-first to seventy-fifth embodiments, further comprising receiving updated sensor data, and updating (e.g. by the control system) the circulation protocol based on updated sensor data.

A seventy-seventh embodiment can include the method of any one of the thirty-seventh to seventy-sixth embodiments, wherein the bellows pump system comprises any one of the first to thirty-sixth system embodiments.

A seventy-eighth embodiment can include the system of any one of the first to thirty-sixth embodiments, configured to carry out the method of any one of the thirty-seventh to seventy-seventh embodiments.

In a seventy-ninth embodiment, a programmable storage device having program instructions stored thereon for causing a processor to perform the method according to any one of the thirty-seventh to seventy-sixth embodiments.

In an eightieth embodiment, a non-transitory computer-readable medium having program instructions stored thereon for causing a control system to perform the method of any one of the thirty-seventh to seventy-sixth embodiments.

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. For example, the various elements or components may be combined or integrated in another system or certain features may be omitted or not implemented. Also, techniques, systems, subsystems, and methods described and illustrated in the various embodiments as discrete or separate may be combined or integrated with other techniques, systems, subsystems, or methods without departing from the scope of this disclosure. Other items shown or discussed as directly coupled or connected or communicating with each other may be indirectly coupled, connected, or communicated with. Method or process steps set forth may be performed in a different order. The use of terms, such as "first," "second," "third" or "fourth" to describe various processes or structures is only used as a shorthand reference to such steps/structures and does not necessarily imply that such steps/structures are performed/formed in that ordered sequence (unless such requirement is clearly stated explicitly in the specification).

Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: $R=Rl+k*(Ru-Rl)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Language of degree used herein, such as "approximately," "about," "generally," and "substantially," represent a value, amount, or characteristic close to the stated value, amount, or characteristic that still performs a desired function or achieves a desired result. For example, the language of degree may mean a range of values as understood by a person of skill or, otherwise, an amount that is +/−10%.

Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded. The use of the terms such as "high-pressure" and "low-pressure" is intended to only be descriptive of the component and their position within the systems disclosed herein. That is, the use of such terms should not be understood to imply that there is a specific operating pressure or pressure rating for such components. For example, the term "high-pressure" describing a manifold should be understood to refer to a manifold that receives pressurized fluid that has been discharged from a pump irrespective of the actual pressure of the fluid as it leaves the pump or enters the manifold. Similarly, the term "low-pressure" describing a manifold should be understood to refer to a manifold that receives fluid and supplies that fluid to the suction side of the pump irrespective of the actual pressure of the fluid within the low-pressure manifold.

It should similarly be understood that terms such as "hot," "cold," "hotter," "cooler," "colder," and other such temperature terms are relative terms and do not denote any specific temperature. Rather, reference to a hot fluid means that the fluid is hotter than a cool fluid of the system and/or has been heated, while reference to a cool fluid means a fluid that is cooler/colder than a hot fluid of the system and/or has not been heated or has been heated less than the fluid of another portion of the system (for example another portion of the system with which the fluid is interacting).

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

As used herein, the term "and/or" includes any combination of the elements associated with the "and/or" term. Thus, the phrase "A, B, and/or C" includes any of A alone, B alone, C alone, A and B together, B and C together, A and C together, or A, B, and C together.

What is claimed is:

1. A system for pumping treatment fluid into a well, comprising:

a bellows pump configured to pump treatment fluid into the well, comprising:

a power end comprising a piston;

a fluid end having a chamber; and an expandable bellows, wherein the power end is configured to reciprocally expand and contract the bellows within the chamber based on movement of drive fluid by the piston; and a make-up system configured to maintain a controlled volume of the drive fluid between the piston and the bellows;

wherein:

the make-up system comprises a make-up fluid source fluidly coupled to the bellows and to at least one additional component of the system;

the make-up system is configured to receive heat from the at least one additional component of the system via circulation of the drive fluid, and to discharge heat through the bellows via circulation of the drive fluid;

further comprising a control system having one or more sensors configured to detect one or more parameters of the system; wherein the control system is configured to receive data from the one or more sensors, to evaluate the sensor data to determine a circulation protocol for circulating the drive fluid between the make-up system and the bellows, and responsive to determining a circulation protocol, to circulate the drive fluid between the make-up system and the bellows based on the circulation protocol; wherein the control system determines the circulation protocol based on temperature, prioritizing flow from whichever of the make-up fluid source or the at least one additional component has hotter drive fluid to the bellows.

2. The system of claim 1, wherein the control system is further configured to evaluate the sensor data to determine whether the bellows and piston are out of sync, and responsive to determining that the bellows and piston are out of sync, to use the make-up system to adjust an amount of the drive fluid between the piston and the bellows to return the piston and bellows to sync.

3. The system of claim 1, wherein the make-up system further comprises at least one make-up valve and at least one make-up pump, wherein responsive to determining the circulation protocol, the control system is configured to operate the make-up pump and/or make-up valve to circulate the drive fluid between the make-up system and the bellows.

4. The system of claim 1, wherein the at least one additional component of the system comprises one of: one or more additional pump, an intensifier, the power end of the pump, a hydraulic circuit configured to reciprocally move the piston within a bore of the power end, hydraulics, lube pumps, cylinders, bellows, pistons/plungers, packing, and combinations thereof.

5. The system of claim 1, wherein the control system determines an amount of time to hold the drive fluid in the bellows, whether to circulate the drive fluid from the make-up fluid source or from the additional component to the bellows, and/or an amount of the drive fluid to circulate to optimize cooling of the drive fluid.

6. The system of claim 1, wherein the control system uses a temperature of the bellows and a temperature of the make-up fluid source to determine the circulation protocol.

7. The system of claim 6, wherein the control system further uses temperature of the at least one additional component to determine the circulation protocol.

8. The system of claim 1, further comprising an external cooler fluidly coupled to the make-up system.

9. The system of claim 1, wherein the control system is configured to hold the drive fluid in the bellows until the drive fluid in the bellows is cooler than the make-up fluid source or the at least one additional component, and then to circulate the drive fluid.

10. A method for cooling a bellows pump system during introduction of treatment fluid into a well, comprising:

pumping treatment fluid into the well using the bellows pump system, wherein the bellows pump system comprises a pump having a bellows and a piston, a control system, and a make-up system configured to keep the piston and bellows in sync, and wherein the make-up system is fluidly coupled to the bellows and to at least one additional component of the system;

responsive to receiving, at the control system, sensor data from one or more sensors configured to detect one or more parameters of the bellows pump system, determining a circulation protocol based on the sensor data for circulating drive fluid to optimize cooling of the drive fluid using the bellows; and responsive to determining a circulation protocol, circulating the drive fluid between the make-up system and the bellows based on the circulation protocol;

wherein the at least one additional component comprises a power end of the pump fluidly coupled to the make-up system, wherein the make-up system comprises a make-up fluid source, and wherein determining a circulation protocol further comprises determining which of the power end and the make-up fluid source contains hotter drive fluid, and circulating the hotter drive fluid to the bellows.

11. The method of claim 10, further comprising evaluating the sensor data to determine whether the bellows and piston are out of sync, and responsive to determining that the bellows and piston are out of sync, using the make-up system to adjust an amount of the drive fluid between the piston and the bellows to return the piston and bellows to sync.

12. The method of claim 10, further comprising receiving heat from the at least one additional component into the make-up fluid system; wherein circulating the drive fluid comprises circulating heated drive fluid into the bellows and dissipating heat from the bellows into the treatment fluid.

13. The method of claim 10, wherein determining a circulation protocol comprises determining an amount of time to hold the drive fluid in the bellows and an amount of the drive fluid to circulate to optimize cooling of the drive fluid.

14. The method of claim 10, further comprising holding the drive fluid in the bellows until the drive fluid is cooler than either the drive fluid in the make-up fluid source or the drive fluid in the power end.

15. The method of claim 14, further comprising, responsive to the drive fluid in the bellows being cooler than either the make-up fluid source or the power end, circulating the drive fluid from the bellows into the hotter of the make-up fluid source or the power end.

16. The method of claim 10, further comprising circulating the drive fluid with an external cooler.

* * * * *